US008885316B2

(12) United States Patent
Sato et al.

(10) Patent No.: US 8,885,316 B2
(45) Date of Patent: Nov. 11, 2014

(54) IONIZER, STATIC CHARGE ELIMINATING SYSTEM, ION BALANCE ADJUSTING METHOD, AND WORKPIECE STATIC CHARGE ELIMINATING METHOD

(75) Inventors: Toshio Sato, Tsukuba (JP); Satoshi Suzuki, Moriya (JP); Takashi Yasuoka, Moriya (JP); Gen Tsuchiya, Moriya (JP)

(73) Assignee: SMC Kabushiki Kaisha, Tokyo (JP)

( * ) Notice: Subject to any disclaimer, the term of this patent is extended or adjusted under 35 U.S.C. 154(b) by 413 days.

(21) Appl. No.: 12/359,634

(22) Filed: Jan. 26, 2009

(65) Prior Publication Data

US 2009/0219663 A1 Sep. 3, 2009

(30) Foreign Application Priority Data

Feb. 28, 2008 (JP) ..... 2008-046993

(51) Int. Cl.
*H01T 23/00* (2006.01)

(52) U.S. Cl.
CPC ..... *H01T 23/00* (2013.01)
USPC ..... 361/230

(58) Field of Classification Search
CPC ..... H01T 23/00; A61L 9/22
USPC ..... 361/230
See application file for complete search history.

(56) References Cited

U.S. PATENT DOCUMENTS

| | | | | |
|---|---|---|---|---|
| 3,711,743 | A * | 1/1973 | Bolasny | 361/231 |
| 4,630,167 | A | 12/1986 | Huggins | |
| 4,809,127 | A | 2/1989 | Steinman et al. | |
| 5,895,632 | A * | 4/1999 | Nomura et al. | 422/186.04 |
| 7,031,133 | B2 | 4/2006 | Riebel et al. | |
| 2003/0043529 | A1* | 3/2003 | Jacobs et al. | 361/220 |
| 2007/0084999 | A1* | 4/2007 | Miller et al. | 250/288 |
| 2007/0133145 | A1 | 6/2007 | Sato et al. | |
| 2007/0279829 | A1 | 12/2007 | Gefter et al. | |
| 2007/0285871 | A1* | 12/2007 | Lee | 361/235 |
| 2008/0130190 | A1* | 6/2008 | Shimada | 361/231 |

FOREIGN PATENT DOCUMENTS

| | | | |
|---|---|---|---|
| DE | 103 48 217 | A1 | 5/2005 |
| DE | 10 2006 055 121 | A1 | 5/2007 |
| DE | 10 2007 049 529 | A1 | 4/2009 |
| JP | 5-299191 | A | 11/1993 |
| JP | 6-47006 | | 6/1994 |
| JP | 11-135293 | A | 5/1999 |

(Continued)

OTHER PUBLICATIONS

Japanese Office Action issued Sep. 4, 2012 in Patent Application No. 2008-046993 (with partial English translation).

(Continued)

*Primary Examiner* — Rexford Barnie
*Assistant Examiner* — Ann Hoang
(74) *Attorney, Agent, or Firm* — Oblon, Spivak, McClelland, Maier & Neustadt, L.L.P.

(57) ABSTRACT

The present invention relates to an ionizer, a static charge eliminating system, an ion balance adjusting method, and a workpiece static charge eliminating method. In an ionizer, when positive and negative voltages are applied to an electrode, an amplitude Vm of the negative voltage is set to be smaller than an amplitude Vp of the positive voltage, and further, the time Tm for which the negative voltage is applied to the electrode is set to be longer than the time Tp for which the positive voltage is applied thereto.

12 Claims, 14 Drawing Sheets

(56) References Cited

FOREIGN PATENT DOCUMENTS

| | | | |
|---|---|---|---|
| JP | 2002-216995 | A | 8/2002 |
| JP | 2002-319470 | A | 10/2002 |
| JP | 2003-187945 | A | 7/2003 |
| JP | 2003-323995 | A | 11/2003 |
| JP | 2006-114255 | A | 4/2006 |
| JP | 2007-149419 | | 6/2007 |
| TW | 200738072 | A | 10/2007 |

OTHER PUBLICATIONS

Combined Taiwanese Office Action and Search Report issued Oct. 18, 2012, in Taiwanese Patent Application No. 098102441 with English translation.

* cited by examiner

IONIZER, STATIC CHARGE ELIMINATING SYSTEM, ION BALANCE ADJUSTING METHOD, AND WORKPIECE STATIC CHARGE ELIMINATING METHOD

BACKGROUND OF THE INVENTION

1. Field of the Invention

The present invention relates to an ionizer for alternately generating positive and negative ions, a static charge eliminating system having such an ionizer, an ion balance adjusting method for adjusting an ion balance of positive ions and negative ions, and a workpiece static charge eliminating method to which the ion balance adjusting method is applied.

2. Description of the Related Art

Heretofore, it has widely been known to neutralize positive or negative electric charges that have charged a workpiece, to thereby eliminate static charges from the workpiece, by releasing positive and negative ions toward the workpiece from an ionizer. In U.S. Pat. No. 4,630,167, U.S. Pat. No. 4,809,127, Japanese Patent Publication No. 06-047006, and Japanese Laid-Open Patent Publication No. 2007-149419, adjustment of the balance (ion balance) between a positive ion amount and a negative ion amount inside of a space (static charge eliminating space) where static charge removal on the workpiece is performed has been proposed, by means of an ionizer which alternately carries out generation of positive ions and negative ions.

With the aforementioned ionizer, as a result of corona discharge occurring at a distal end side of an electrode caused by application of positive or negative voltages with respect to the electrode, positive ions or negative ions are generated inside the static charge eliminating space. In this case, as confirmed by the present applicants, the density of ozone (ozone density) generated inside the static charge eliminating space caused by corona discharge is greater when a negative voltage is applied with respect to the electrode than when a positive voltage is applied with respect to the electrode (see FIGS. 10A and 10B). Owing thereto, metals (for example, the electrode, etc.) utilized in the ionizer become oxidized and corroded as a result of the generation of ozone by application of the negative voltage. Alternatively, the user of the ionizer tends to sense the ozone as an unusual odor.

With respect to these problems, by decreasing the absolute value of the negative voltage applied to the electrode, the ozone density can be reduced (see, FIG. 10A). However, if the absolute value of the negative voltage is reduced, the field intensity at the distal end side of the electrode decreases and the generated amount of negative ions is reduced, such that the ion balance of positive ions and negative ions is subject to deterioration. Therefore, the time required to eliminate static charges from the workpiece (hereinafter referred to as the "charge removal time") becomes considerably longer (see, FIG. 11A). Accordingly, the above-mentioned problems cannot be overcome and resolved simply by reducing the absolute value of the negative voltage.

SUMMARY OF THE INVENTION

An object of the present invention is to realize in one sweep a reduction in the generated amount of ozone, while maintaining ion balance and shortening the time required to eliminate static charges from a workpiece.

To achieve these objects, the ionizer according to the present invention comprises at least one electrode, wherein an absolute value of a negative voltage applied to the electrode is set to be smaller than an absolute value of a positive voltage applied to the electrode, whereas a time period for which the negative voltage is applied to the electrode is set to be longer than a time period for which the positive voltage is applied to the electrode, and wherein generation of positive ions in a static charge eliminating space by application of the positive voltage to the electrode is carried out alternately with generation of negative ions in the static charge eliminating space by application of the negative voltage to the electrode.

Further, to achieve the aforementioned objects, the ionizer according to the present invention comprises at least two electrodes, wherein an absolute value of a negative voltage applied to one of the electrodes is set to be smaller than an absolute value of a positive voltage applied to another of the electrodes, and a time period for which the negative voltage is applied to the one electrode is set to be longer than a time period for which the positive voltage is applied to the other electrode, and wherein generation of positive ions in a static charge eliminating space by application of the positive voltage to the other electrode is carried out alternately with generation of negative ions in the static charge eliminating space by application of the negative voltage to the one electrode.

In accordance with the present invention, when positive and negative voltages are applied with respect to the electrode, an absolute value of the negative voltage is set to be smaller than an absolute value of the positive voltage, whereas a time period (also referred to as "application time") for which the negative voltage is applied to the electrode is set to be longer than a time period (application time) for which the positive voltage is applied to the electrode. Stated otherwise, the absolute value of the positive voltage is set larger than the absolute value of the negative voltage, and the time period for which the positive voltage is applied is set shorter than the time period for which the negative voltage is applied.

In other words, since the absolute value of the negative voltage is set comparatively smaller, even if the positive voltage and the negative voltage are applied alternately to the electrode and positive ions and negative ions are generated in the static charge eliminating space, generation of ozone by application of negative voltage can reliably be suppressed. As a result, the generated amount of ozone is reduced, and oxidation of metals utilized by the ionizer can be prevented securely, thereby enhancing the commercial value of the ionizer.

Further, because the time for which the negative voltage is applied is set to be longer corresponding to a reduction in the absolute value of the negative voltage, the application time of the positive voltage inevitably is set smaller. In view thereof, the absolute value of the positive voltage is set larger. More specifically, by lengthening the application time of the negative voltage, the reduction in the generated amount of negative ions due to reducing the absolute value of the negative voltage is compensated for, whereas on the other hand, by increasing the absolute value of the positive voltage, the reduction in the generated amount of positive ions due to shortening the application time of the positive voltage is compensated for. Consequently, the ion balance between the positive ions and the negative ions can easily be adjusted (maintained), and static charges that have charged the workpiece can be eliminated quickly.

Therefore, according to the present invention, by alternately applying the positive voltage and the negative voltage to the electrode and alternately generating positive ions and negative ions at the aforementioned setting conditions, the generated amount of ozone can be reduced, while at the same time maintaining ion balance, and shortening the time required to eliminate static charges from a workpiece.

Herein, the aforementioned ionizer further includes an ion balance detecting means for detecting an ion balance of the positive ions and the negative ions in the static charge eliminating space, and a control means for controlling the positive voltage and/or the negative voltage, wherein the control means adjusts the absolute value of the positive voltage and/or the negative voltage based on a detection result of the ion balance at the ion balance detecting means.

Owing thereto, even in the event that dust becomes adhered to the electrode and contaminates the electrode, or if the generated amount of positive ions and/or negative ions is reduced as a result of the electrode becoming worn due to use of the ionizer over an extended time period, by adjusting the absolute value of the positive voltage and/or the negative voltage based on such a detection result, changes over time in the ion balance and in the time required to eliminate static charges can be suppressed.

More specifically, in the case of a detection result, which indicates that the amount of positive ions is greater than the amount of negative ions in the static charge eliminating space, assuming the control means increases the absolute value of the negative voltage corresponding to a difference between the amount of positive ions and the amount of negative ions, even if the ion balance is shifted to the positive ion side by decreasing the amount of generated negative ions, the shift in ion balance can be reliably detected and quickly adjusted.

In this case, the ionizer includes a warning means, such that, when the absolute value of the negative voltage is increased, the control means outputs a determination result to the warning means if it is determined that the absolute value of the negative voltage after being increased exceeds a predetermined threshold, and the warning means notifies the determination result externally.

Owing thereto, a user of the ionizer can determine that the electrode has become contaminated due to dust being adhered thereto, or that the electrode has become worn, and as a result there is a fear that the time to remove static charges will be prolonged. In this case, the user can quickly perform a procedure to replace the electrode or the like, and therefore maintenance of the ionizer is facilitated.

More specifically, because the absolute value of the negative voltage is smaller than the absolute value of the positive voltage, when the electrode becomes contaminated, the generated amount of negative ions is reduced in a short time interval to be smaller than the generated amount of positive ions. Further, because the absolute value of the positive voltage is greater than the absolute value of the negative voltage, even if the electrode becomes contaminated, the generated amount of positive ions is not degraded to the same degree as the generated amount of negative ions. Accordingly, compared with the generated amount of positive ions, the generated amount of negative ions changes sensitively with respect to contamination of the electrode. Consequently, in the present invention, as discussed above, since it can be determined whether the electrode has become contaminated by judging whether or not the absolute value of the negative voltage has exceeded the predetermined threshold, contamination of the electrode can be promptly and accurately detected.

Further, in the event that the detection result indicates that an amount of the negative ions is greater than the amount of positive ions in the static charge eliminating space, the control means may decrease the absolute value of the negative voltage corresponding to a difference between the amount of positive ions and the amount of negative ions. Owing thereto, even if the ion balance is shifted to the negative ion side, the shift in ion balance can be reliably detected and quickly adjusted. Specifically, in the present invention, as discussed above, since the generated amount of negative ions is easily changed, the ion balance can be reliably adjusted by changing the absolute value of the negative voltage.

Herein, the ion balance detecting means may include a current detecting means, which is connected to ground, wherein the electrode is connected to the current detecting means via the control means. The current detecting means detects a current corresponding to the amount of positive ions and the amount of negative ions flowing between the electrode and the current detecting means via the static charge eliminating space and the ground, and the control means may adjust the absolute value of the positive voltage and/or the negative voltage based on a size and direction of the current detected by the current detecting means.

Further, the ion balance detecting means may include a potential detecting means arranged inside the static charge eliminating space, for detecting a potential corresponding to the amount of positive ions and the amount of negative ions in the static charge eliminating space. The control means may adjust the absolute value of the positive voltage and/or the negative voltage based on a size and polarity of the potential detected by the potential detecting means.

Owing thereto, in the case the current is detected, or in the case that the potential is detected, shifts in ion balance can easily be adjusted based on such detection results.

Furthermore, assuming that a sum of a time period during which the positive voltage is applied one time to the electrode and a time period during which the negative voltage is applied one time to the electrode equals one period, the control means may calculate a time average of ion balance of the positive ions and the negative ions over at least the one period, and may adjust the absolute value of the positive voltage and/or the negative voltage based on the calculation result thereof. Owing thereto, a shift in the ion balance can be adjusted with good precision.

In this case, the control means includes a controller that generates a control signal, and a voltage generator connected to the electrode, which generates the positive voltage and the negative voltage based on the control signal and applies the positive voltage and the negative voltage to the electrode, wherein, when the ion balance detecting means detects the ion balance, the controller generates the control signal corresponding to the detection result, and the voltage generator adjusts the absolute value of the positive voltage and/or the negative voltage based on the control signal.

Owing thereto, a feedback control for adjusting the absolute value of the positive voltage and/or the negative voltage corresponding to shifts in the ion balance can be securely realized.

Further, assuming the electrode is a needle-shaped electrode, because the field intensity at the distal end side of the needle-shaped electrode becomes large when the positive voltage or the negative voltage is applied thereto, the generated amount of positive ions or negative ions can easily be increased.

In this case, positive ions and negative ions are generated at the distal end side of the needle-shaped electrode within the static charge eliminating space, and a plate shaped ground electrode may be arranged at a base end side of the needle-shaped electrode distanced from the needle-shaped electrode. Owing thereto, since the electric field intensity at the distal end side of the needle-shaped electrode is determined by the positional relationship between the needle-shaped electrode and the ground electrode, fluctuations in the generated amount of positive ions and negative ions due to the distance between the needle-shaped electrode and the workpiece can reliably be suppressed.

Furthermore, preferably, in the ionizer, the polarity of voltage applied to the electrode is changed at a given timing determined by an external signal. At this time, if a plurality of ionizers are employed, it is preferable for the polarities of voltages applied to the electrodes all to be changed simultaneously, at the timing determined by the signal.

Further, in the case that a plurality of ionizers are employed, among each of such ionizers, preferably one of the ionizers outputs a synchronizing signal to the other ionizer, so that the polarities of voltages applied to the electrodes all are changed simultaneously, at a timing determined by the synchronizing signal.

Owing thereto, in the case that one ionizer is driven to eliminate static charges from the workpiece, or in the case that a plurality of ionizers are driven simultaneously to eliminate static charges from the workpiece, because the voltage polarity is switched in synchronism with the signal (synchronizing signal), elimination of static charges with respect to the workpiece can be carried out with high efficiency.

Furthermore, when generation of positive ions and generation of negative ions is carried out alternately in the static charge eliminating space as described above, the workpiece is transported into the static charge eliminating space by a workpiece transporting means, and by neutralizing electric charges that have charged the workpiece by means of the positive ions and the negative ions, and thus eliminating static charges from the workpiece, the electrical charges that have charged the workpiece can be eliminated rapidly.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIGS. 13A through 13E are time charts showing switching in polarity of voltages applied to the electrode needles of the ionizers shown in FIG. 12.

DESCRIPTION OF THE PREFERRED EMBODIMENTS

A preferred embodiment of the present invention shall be presented and explained in detail below with reference to the accompanying drawings.

Figure 1:
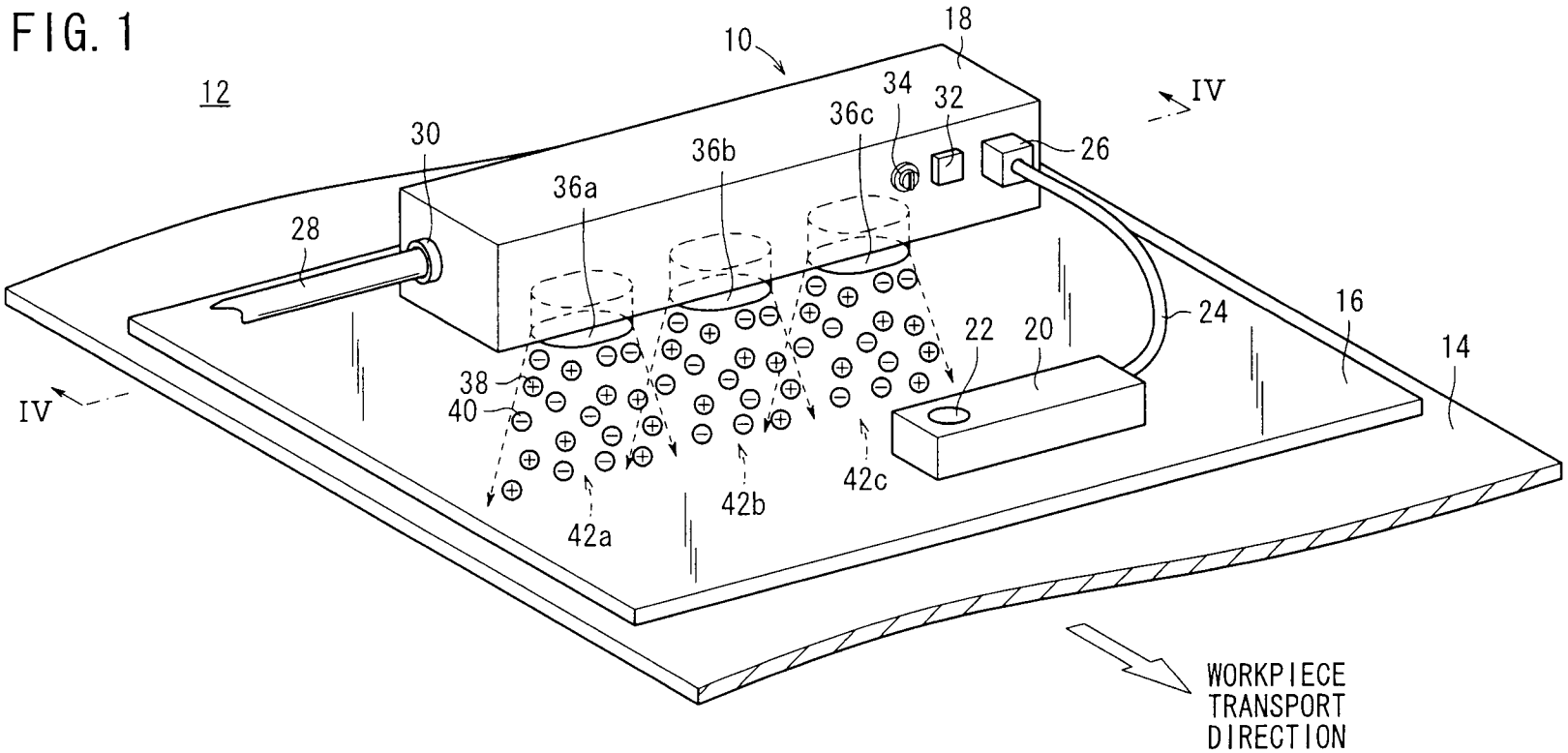
FIG. 1 is a perspective view of a static charge eliminating system according to an embodiment of the present invention.
Figure 2:
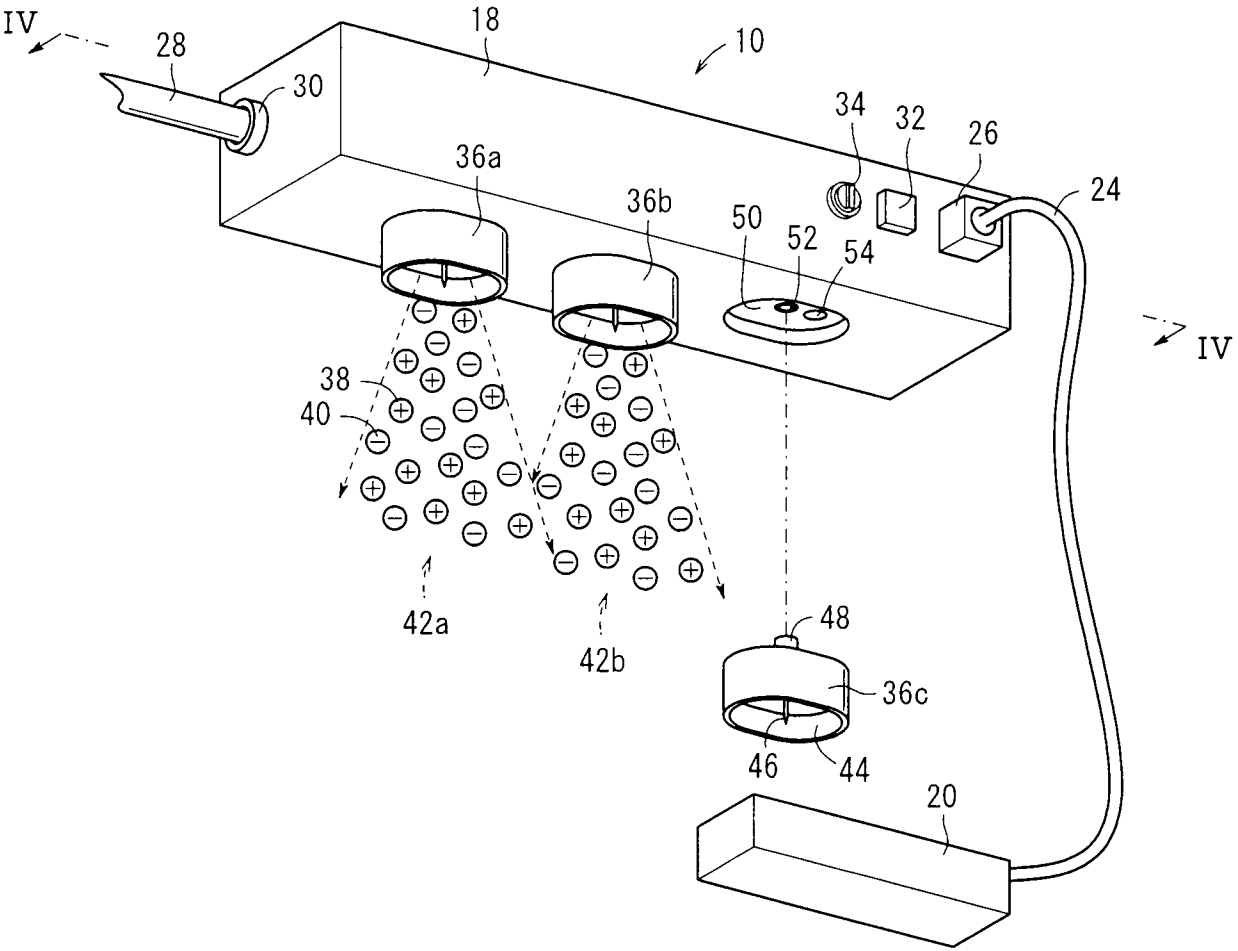
FIG. 2 is a perspective view of an ionizer shown in FIG. 1.

As shown in FIGS. 1 and 2, a static charge eliminating system 12, to which the ionizer 10 according to the present embodiment is applied, is a system that serves to neutralize positive or negative charges that have charged a workpiece 16 transported on a conveyor (workpiece transporting means) 14, and thereby eliminate static charges from the workpiece 16, by releasing positive ions 38 and negative ions 40 from the ionizer 10. The workpiece 16 is constituted by, for example, a glass substrate or film, whereas the static charge eliminating system 12 is applied to eliminate charges with respect to the glass substrate or film, which is transported on the conveyor 14 in a factory or the like. Further, in FIGS. 1 and 2, for facilitating understanding, "+" symbols are printed inside circles and indicate positive ions 38, and "–" symbols are printed inside circles and indicate negative ions 40.

A substantially rectangular shaped main body 18 of the ionizer 10 is arranged above the conveyor 14 that transports the workpiece 16, so as to lie substantially perpendicular to a direction in which the workpiece 16 is transported (i.e., along the widthwise direction of the conveyor 14). On the front surface of the main body 18 (on a downstream side of the transport direction of the workpiece 16), a surface potential sensor (ion balance detecting means, potential detecting means) 20 is connected through a cable 24 and a connector 26, and on a side surface of the main body 18, a flow passage 28 is connected through a connector 30. Further, on the front surface of the main body 18, a display device (warning means) 32 made up of an LED or the like, and a frequency selection switch 34 are arranged, and on a bottom surface thereof that confronts the workpiece 16, electrode cartridges 36*a* to 36*c*, each of which are equipped with an electrode needle (needle-shaped electrode) 46 therein, are mounted at predetermined intervals.

Figure 5:
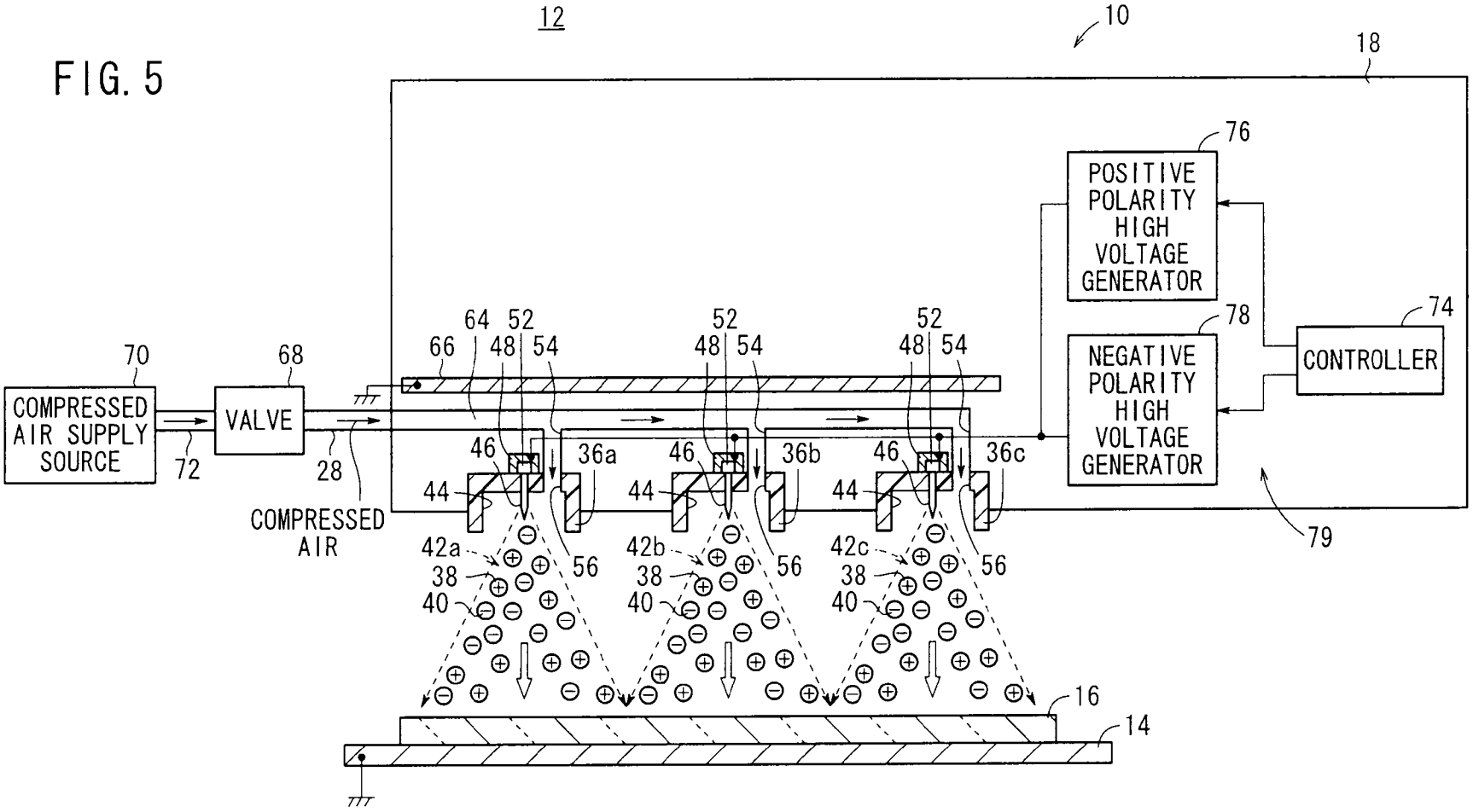
FIG. 5 is a schematic block diagram of a static charge eliminating system.

When a positive voltage (high voltage of a positive polarity) or a negative voltage (high voltage of a negative polarity) is applied respectively to the electrode needle 46 of each of the electrode cartridges 36*a* to 36*c*, positive ions 38 or negative ions 40 are generated by corona discharge at the distal end sides (i.e., workpiece 16 side) of the electrode needles 46, and the generated positive ions 38 or negative ions 40 are released in a direction toward the workpiece 16 from the electrode cartridges 36*a* to 36*c*. The surface potential sensor 20 detects, through a detection plate 22 that serves as a detection surface, a potential, which corresponds to a balance (ion balance) between the amount of positive ions 38 and the amount of negative ions 40, in spaces (hereinafter referred to as "static charge eliminating spaces") 42*a* to 42*c* where positive ions 38 and negative ions 40 are generated and static charge on the workpiece 16 is eliminated. In this case, as shown in FIGS. 1, 2 and 5, the above-mentioned static charge eliminating spaces 42*a* to 42*c* are enlarged toward the workpiece 16 from the distal end sides of the electrode needles 46 of the electrode cartridges 36*a* to 36*c*. More specifically, in order to reliably eliminate static charges from the workpiece 16 transported on the conveyor 14, each of the static charge eliminating spaces 42*a* to 42*c* is formed to cover an upper surface of the workpiece 16 along the widthwise direction of the conveyor 14 (see FIG. 5). The structure of the surface potential sensor 20 is well known from Japanese Laid-Open Patent Publication No. 2007-149419. Therefore, detailed explanations of the surface potential sensor 20 have been omitted from the present specification.

Further, as shown in FIGS. 1, 2, 3A and 4A, elliptically columnar shaped electrode cartridges 36*a* to 36*c*, formed from an electrical insulating material (e.g., a resin material having electrical insulating properties), are mountable into recesses 50 on the bottom surface side of the main body 18. In this case, cavities 44 are formed in the electrode cartridges 36*a* to 36*c*, on bottom surfaces thereof on the workpiece 16 side, and holes 56 are formed on upper surfaces thereof on the main body 18 side, which communicate with the cavities 44. Further, distal ends of the electrode needles 46, which may be made of tungsten (W) or silicon (Si) materials, project from the cavities 44 toward the workpiece 16, whereas the base ends of the electrode needles 46 are formed as cylindrical columnar shaped terminals 48. On the other hand, receiving openings 52, and holes 54 which communicate with a flow passage 64 formed inside the main body 18, are disposed respectively in the recesses 50 of the main body 18. Owing thereto, when the user of the static charge eliminating system 12 attaches the electrode cartridges 36*a* to 36*c* to the main body 18 of the ionizer 10, the receiving openings 52 and the terminals 48 are fitted together, and the cavities 44 are made to communicate with the flow passage 64 through the holes 56 and 54 (see, FIG. 4A and FIG. 5).

Furthermore, a plate-shaped ground electrode 66, which is separated from the terminals 48 of the electrode needles 46, a positive polarity high voltage generator 76 and a negative polarity high voltage generator 78, which serve as voltage generators connected to each of the terminals 48, and a controller (control section) 74 that controls the positive polarity high voltage generator 76 and the negative polarity high voltage generator 78, are disposed respectively in the main body 18. The controller 74, the positive polarity high voltage generator 76 and the negative polarity high voltage generator 78 collectively constitute a control means 79, which is connected to the electrode needles 46 of the electrode cartridges 36*a* to 36*c*. Further, a compressed air supply source (air supply source) 70 is connected to the flow passage 64 of the main body 18 through a flow passage 72, a valve 68, and the flow passage 28, such that when the valve 68 is opened, compressed air (air) can be supplied to the cavities 44 from the compressed air supply source 70, through the flow passage 72, the valve 68, the flow passages 28, 64, and the holes 54, 56.

Figure 3A:
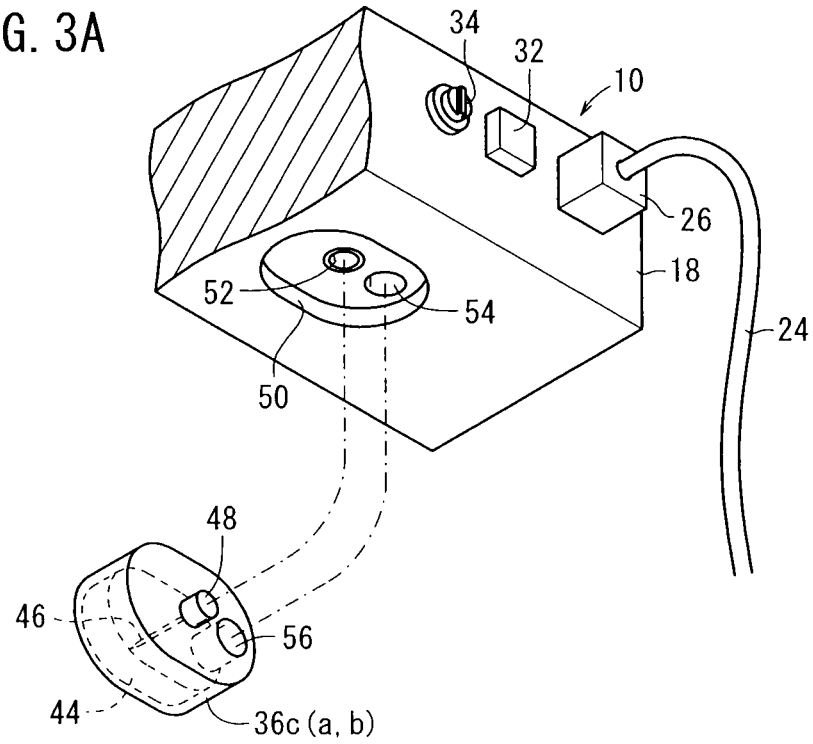
FIG. 3A and FIG. 3B are perspective views showing when an electrode cartridge is taken out from a main body of the ionizer.
Figure 3B:
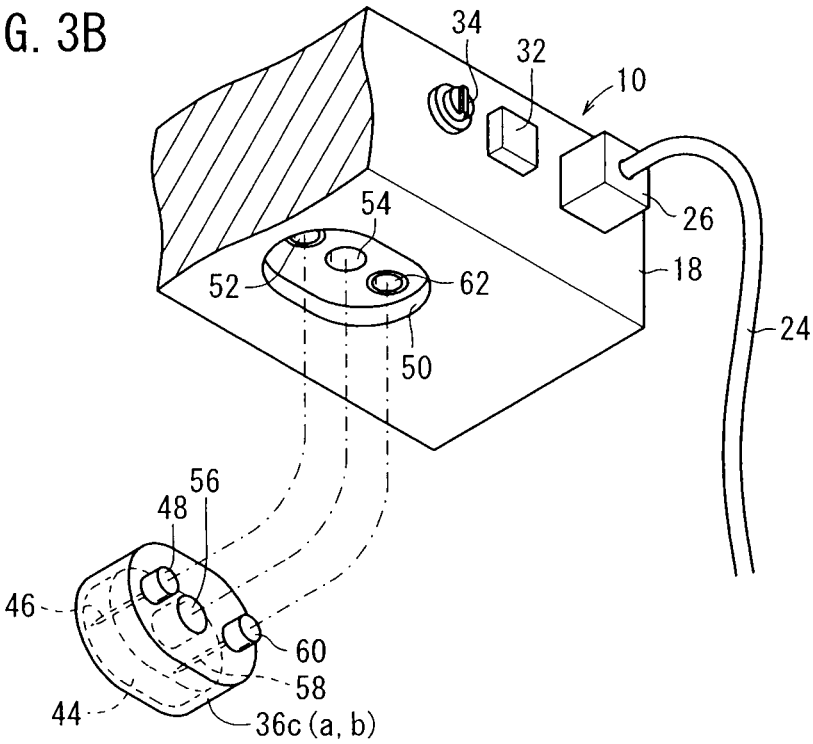
Figure 4A:
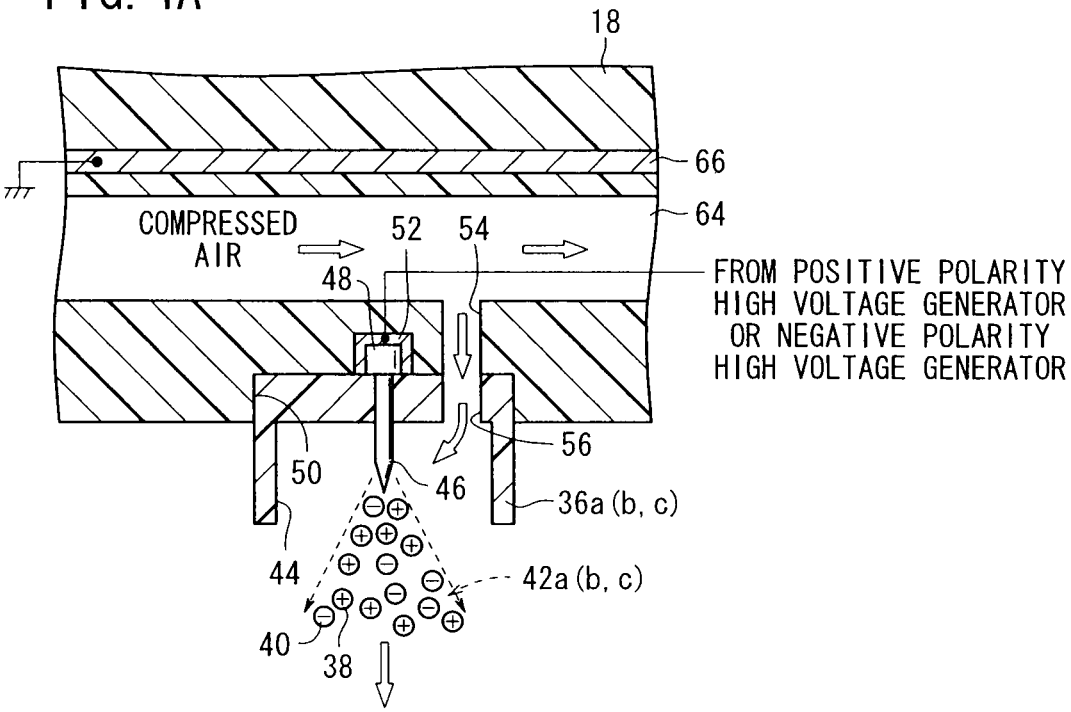
FIG. 4A and FIG. 4B are cross sectional views taken along line IV-IV in FIG. 1 and FIG. 2.
Figure 4B:
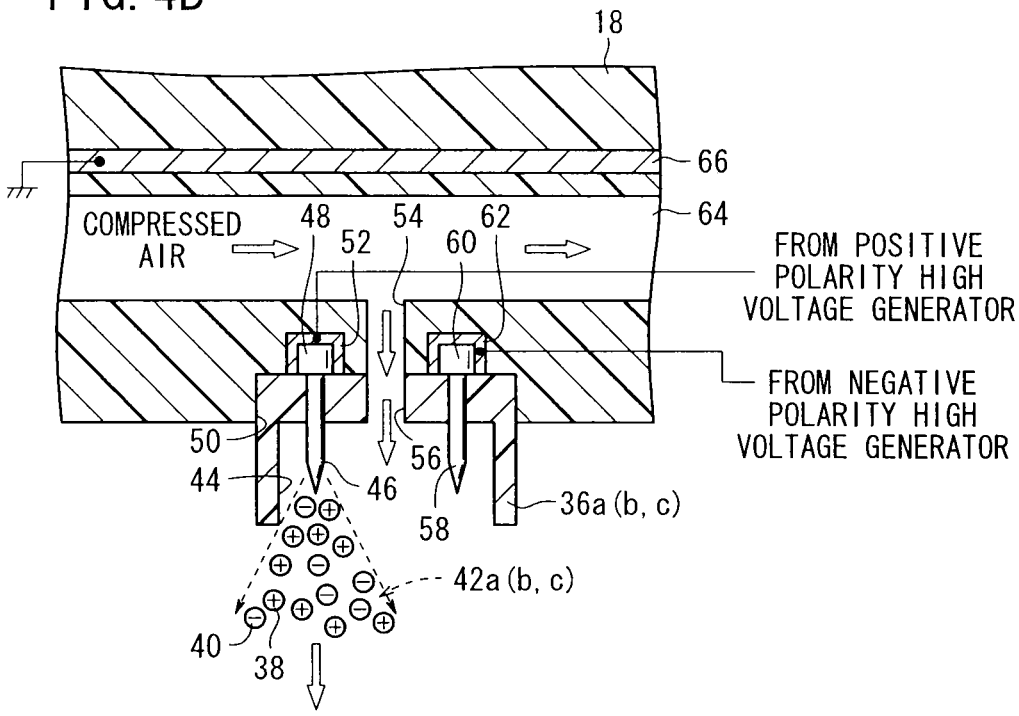

In the foregoing explanation, a description has been given concerning a case in which one electrode needle 46 is mounted in each of the electrode cartridges 36*a* to 36*c*. However, as shown in FIGS. 3A and 4B, two electrode needles 46, 58, which are separated by a given distance, may be mounted in each of the electrode cartridges 36*a* to 36*c* with a hole 56 formed between the electrode needles 46, 58, wherein receiving openings 52, 62 and a hole 54 are provided in the recesses 50 of the main body 18 corresponding to the positions of the terminals 48, 60 of the electrode needles 46, 58 and the hole 56. In this case, the terminal 48 of the electrode needle 46 is connected to the positive polarity high voltage generator 76 through the receiving opening 52, whereas the terminal 60 of the electrode needle 58 is connected to the negative polarity high voltage generator 78 through the receiving opening 62. Further, FIG. 4B shows a case in which a positive voltage is applied to the electrode needle 46 and positive ions 38 are generated and released into the static charge eliminating spaces 42*a* to 42*c*, having both positive ions 38 and negative ions 40 residing therein.

Figure 6:
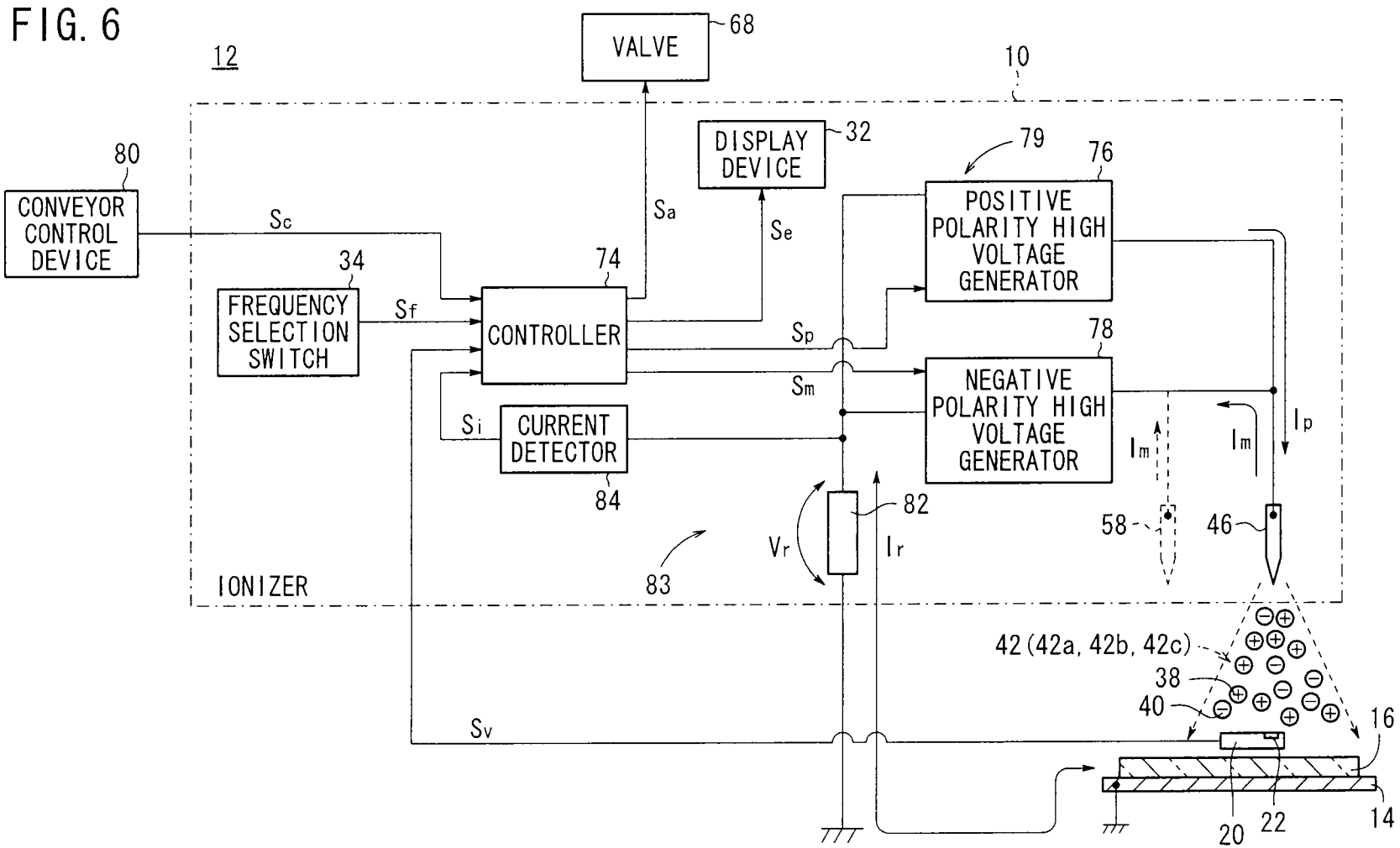
FIG. 6 is a schematic block diagram of a static charge eliminating system.

FIG. 6 is a block diagram of the static charge eliminating system 12.

The ionizer 10, in addition to the aforementioned electrode needle 46 (and the electrode needle 58), the display device 32, the frequency selection switch 34, the controller 74, the positive polarity high voltage generator 76 and the negative polarity high voltage generator 78, also includes a resistor 82 and a current detector 84 that constitute a current detecting means (ion balance detecting means) 83. In this case, the electrode needle 46 is connected to the resistor 82 through the positive polarity high voltage generator 76 and the negative polarity high voltage generator 78, and the resistor 82 is connected to ground (earth). In the case that the ionizer 10 is equipped with two electrode needles 46, 58, the electrode needle 46 is connected to the resistor 82 through the positive polarity high voltage generator 76, whereas the electrode needle 58 (shown by the broken line in FIG. 6) is connected to the resistor 82 through the negative polarity high voltage generator 78. Further, the conveyor 14 that transports the workpiece 16 functions as a ground electrode, while being controlled by a conveyor control device 80.

The flow passages 28, 64, 72, each of the electrode cartridges 36*a* to 36*c*, the terminals 48, 60, the receiving openings 52, 62, the holes 54, 56, the ground electrode 66 and the compressed air supply source 70, etc., which were described above in FIGS. 1 to 5, have been omitted from illustration in FIG. 6.

Herein, the conveyor control device 80 outputs a conveyor control signal Sc, which indicates that the conveyor 14 is currently under operation, to the controller 74, at times when the conveyor 14 is being operated (i.e., when a workpiece 16 is being transported thereby).

The frequency selection switch 34, by operation thereof by the user, sets the frequency of the voltage applied to the electrode needle 46 (and the electrode needle 58), and outputs a signal (frequency setting signal) Sf indicating the selected frequency to the controller 74.

Figure 8A:
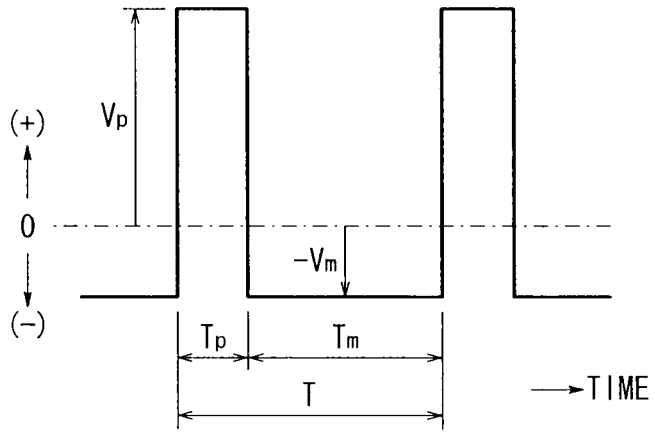
FIG. 8A is a time chart of the voltage applied to an electrode needle at an application initiation time.
Figure 8B:
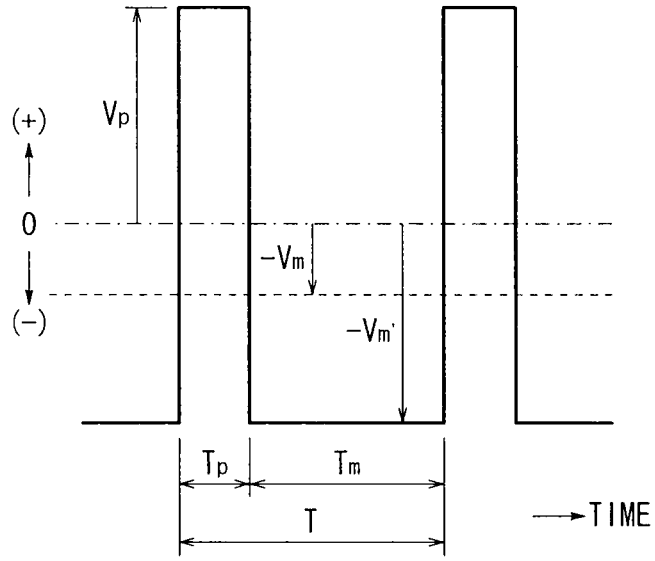
FIG. 8B is a time chart of the voltage applied to the electrode needle after an amplitude change of a negative voltage.

The controller 74, on the one hand, repeatedly outputs a positive voltage control signal Sp at a predetermined time interval (the period T shown in FIG. 8A) to the positive polarity high voltage generator 76, and on the other hand, repeatedly outputs a negative voltage control signal Sm at a predetermined time interval (period T) to the negative polarity high voltage generator 78. In this case, the positive voltage control signal Sp is a signal indicating the amplitude Vp (absolute value) of the positive voltage to be output from the positive polarity high voltage generator 76, a duty ratio and frequency of the positive voltage, and a timing at which the positive voltage is output, whereas the negative voltage control signal Sm is a signal indicating the amplitude Vm (absolute value) of the negative voltage to be output from the negative polarity high voltage generator 78, a duty ratio and frequency of the negative voltage, and a timing at which the negative voltage is output.

Owing thereto, by the controller 74, the positive voltage control signal Sp is output to the positive polarity high voltage generator 76, and the negative voltage control signal Sm is output to the negative polarity high voltage generator 78, so that positive and negative voltages are alternately generated within a time of the period T determined by the frequency. More specifically, the controller 74, within one period T, allocates an initial time period Tp to a time band in which the positive voltage (positive polarity high voltage pulse) having amplitude Vp is output from the positive polarity high voltage generator 76 (see FIG. 8A), while on the other hand, allocates a time period Tm after the time period Tp to a time band in which the negative voltage (negative polarity high voltage pulse) having amplitude Vm is output from the negative polarity high voltage generator 78. The positive voltage control signal Sp and the negative voltage control signal Sm which correspond to such allocations are output respectively to the positive polarity high voltage generator 76 and the negative polarity high voltage generator 78.

The positive polarity high voltage generator 76 generates the positive voltage within the time band of the period Tp and applies it to the electrode needle 46 based on the input positive voltage control signal Sp, and on the other hand, the negative polarity high voltage generator 78 generates the negative voltage within the time band of the period Tm and applies it to the electrode needle 46 or the electrode needle 58 based on the input negative voltage control signal Sm. Accordingly, the positive voltage and the negative voltage are applied alternately and repeatedly to the electrode needles 46, 58, which are formed as needle-shaped electrodes. As a result, positive ions 38 and negative ions 40 are generated alternately and repeatedly in the static charge eliminating space 42 (42*a* to 42*c*).

At this time, a positive electric current Ip caused by the positive ions 38 flows from the positive polarity high voltage generator 76 to the electrode needle 46, whereas a negative current Im caused by the negative ions 40 flows from the electrode needle 46 or the electrode needle 58 to the negative polarity high voltage generator 78. Further, a current (hereinafter referred to as a return current) Ir flows from the resistor 82, through ground, the conveyor 14, the workpiece 16 and the charge eliminating space 42 to the electrode needle 46 (and the electrode needle 58), and a voltage drop Vr due to the return current Ir is generated across the resistor 82. The current detector 84 measures the voltage drop Vr, detects the size and direction of the return current Ir based on the measured voltage drop Vr, and outputs a current detection signal Si to the controller 74, which indicates the size and direction of the detected current Ir.

The return current Ir is a current corresponding to a summation of the current Ip based on the positive ions 38 and the current Im based on the negative ions 40. Therefore, in the event that the amount of positive ions 38 is greater than the amount of negative ions 40 ($|Ip|>|Im|$), the return current Ir flows from the conveyor 14 to the resistor 82 through ground. On the other hand, in the event that the amount of negative ions 40 is greater than the amount of positive ions 38 ($|Ip|<|Im|$), the return current Ir flows from the resistor 82 to the conveyor 14 through ground. Further, when the positive ions 38 and the negative ions 40 are in substantially equal amounts, the ion balance is in a state of equilibrium, thus resulting in $|Ip|=|Im|$, and as a result, $Ir=0$.

Furthermore, the surface potential sensor 20 detects a potential at a position of the detection plate 22 inside the static charge eliminating space 42, and outputs a potential signal Sv, indicating the size and polarity of the detected potential, to the controller 74.

Accordingly, the controller 74 can grasp and perceive the ion balance in the static charge eliminating space 42 based on the current detection signal Si and/or the potential signal Sv. Specifically, the controller 74 calculates a time average of the return current Ir and/or the potential during at least one period T (alternatively, two periods or more), and judges from the calculation result whether or not the ion balance is in equilibrium. More specifically, if the time average of the return current Ir and/or the potential is substantially at a zero level, the controller 74 determines that the ion balance is in equilibrium (the amount of positive ions 38 and the amount of negative ions 40 are taken to be in balance), and the currently set positive voltage control signal Sp and negative voltage control signal Sm continue to be output in an ongoing manner, respectively, to the positive polarity high voltage generator 76 and the negative polarity high voltage generator 78.

On the other hand, in the case that the time average of the return current Ir and/or the potential is not at a zero level, and is of a given level having a positive or negative polarity, the controller 74 judges that the ion balance has been destroyed, and changes the currently set positive voltage control signal Sp and the negative voltage control signal Sm to signals that are capable of compensating the shift in ion balance.

More specifically, in the case where the controller 74 judges that the time average of the return current Ir and/or the potential is of a positive level, that is, that the return current Ir is a current having a positive direction (i.e., of the same direction as the positive current Ip, having a direction from the conveyor 14 toward the resistor 82 through ground) and/or that the potential is positive, it is determined that the ion balance has shifted in favor of the positive ions 38, such that the amount of positive ions 38 is greater than the amount of negative ions 40 ($|Ip|>|Im|$) in the static charge eliminating space 42. Next, in order to obtain $Ir=0$ (i.e., to equalize the amounts of positive ions 38 and negative ions 40 with each other by $|Ip|=|Im|$), the controller 74 generates the negative voltage control signal Sm for increasing the amplitude Vm of the negative voltage, and outputs the same to the negative polarity high voltage generator 78.

Further, in the case where the controller 74 judges that the time average of the return current Ir and/or the potential is of a negative level, that is, that the return current Ir is a current having a negative direction (i.e., of the same direction as the negative current Im, having a direction from the resistor 82 toward the conveyor 14 through ground) and/or that the potential is negative, it is determined that the ion balance has shifted in favor of the negative ions 40, such that the amount of negative ions 40 is greater than the amount of positive ions 38 ($|Ip|<|Im|$). Next, in order to obtain $Ir=0$, the controller 74 generates the negative voltage control signal Sm for decreasing the amplitude Vm of the negative voltage, and outputs the same to the negative polarity high voltage generator 78, or alternatively, generates the positive voltage control signal Sp for increasing the amplitude Vp of the positive voltage, and outputs the same to the positive polarity high voltage generator 76.

Accordingly, by the controller 74 either increasing and decreasing the amplitude Vm of the negative voltage or increasing the amplitude Vp of the positive voltage based on (the time average of) the return current Ir and/or the potential, a feedback control is carried out for adjusting the ion balance of the positive ions 38 and the negative ions 40.

Moreover, as described below, because the generated amount of negative ions 40 changes sensitively due to contamination of the electrode needles 46, 58, the controller 74 basically carries out a feedback control in order to increase and decrease the amplitude Vm of the negative voltage, while the amplitude Vp of the positive voltage is maintained at a predetermined level.

Accordingly, in the following description, a detailed explanation shall be given concerning a case in which the amplitude Vm of the negative voltage is increased and decreased to adjust the ion balance. As described above, because the ionizer 10 according to the present embodiment also is capable of changing the amplitude Vp of the positive voltage, naturally, the ion balance can be adjusted by increasing and decreasing the amplitude Vm of the negative voltage and/or the amplitude Vp of the positive voltage.

Figure 9:
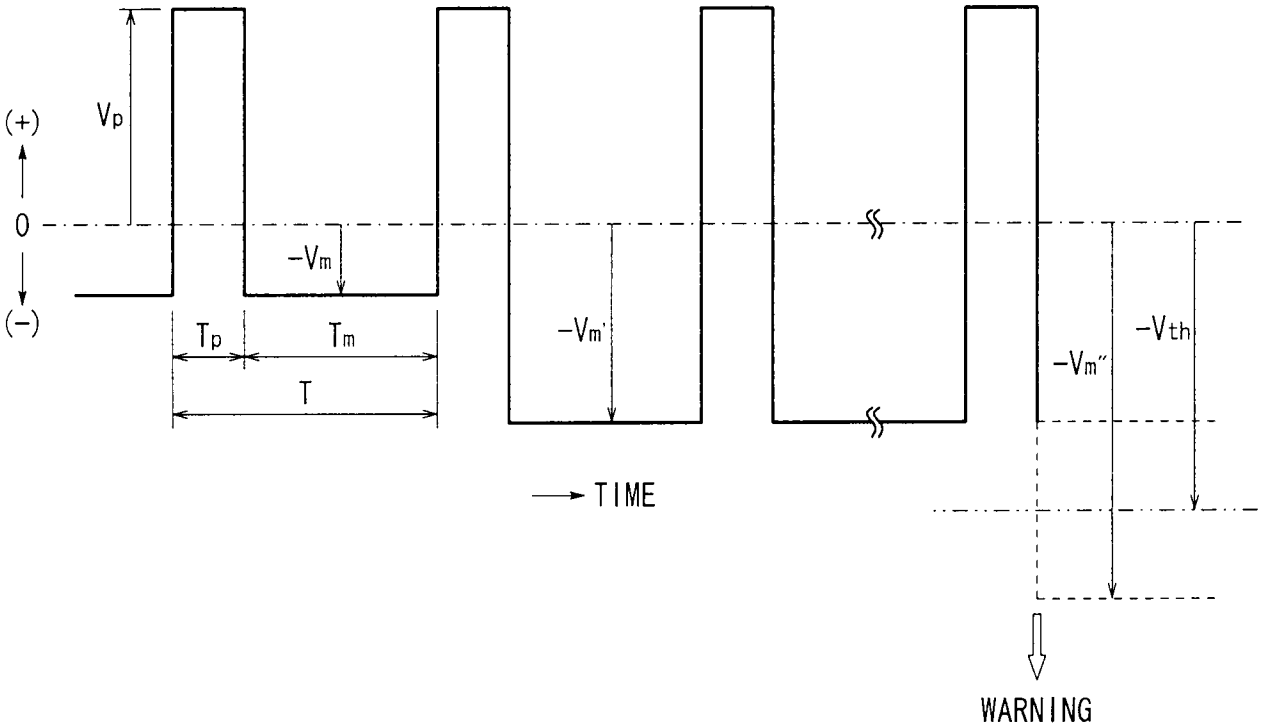
FIG. 9 is a time chart of the voltage applied to the electrode needle from the application initiation time until a warning time.
Figure 10A:
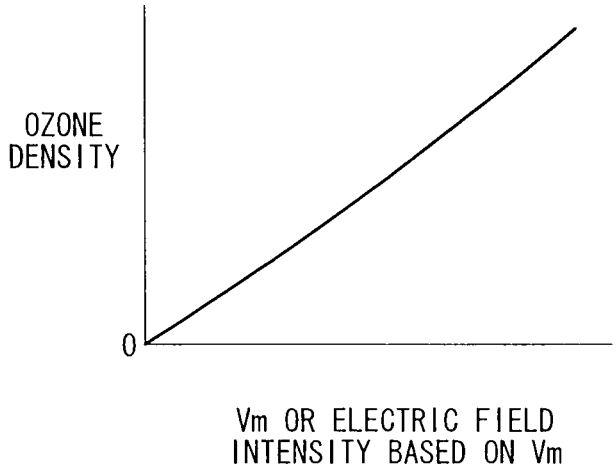
FIG. 10A is a graph showing ozone density generated on a distal end side of the electrode needle upon application of a negative voltage.
Figure 10B:
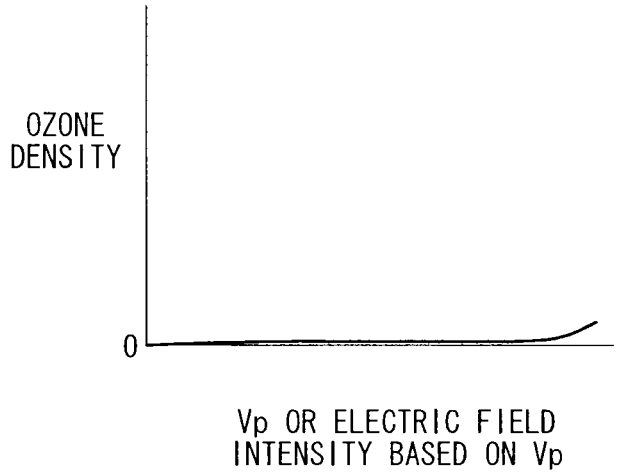
FIG. 10B is a graph showing ozone density generated on a distal end side of the electrode needle upon application of a positive voltage.

Furthermore, when the controller 74 increases the amplitude Vm of the negative voltage, or after increasing thereof, further increases an amplitude Vm' of the negative voltage, and determines that an amplitude Vm" after such an increase has exceeded a predetermined threshold Vth (see FIG. 9) (Vm">Vth), a warning signal Se, which indicates that the threshold Vth has been exceeded, is output to the display device 32. Based on the warning signal Se input thereto, the display device 32 warns the user of the static charge eliminating system 12. The threshold Vth is defined, for example, as a voltage value, which occurs at a time, such that even if a negative voltage having a voltage level above the threshold Vth is applied to the electrode needles 46, due to adhering of dust on the distal end side or wearing of the distal end side of the electrode needles 46, 58 by use of the ionizer 10 over a prolonged period of time, an increase in the generated amount of negative ions cannot be expected, and as a result, the time required to eliminate static charges with respect to the workpiece 16 is expected to increase in length.

In addition, when the conveyor control signal Sc is not input from the conveyor control device 80 to the controller 74, the controller 74 determines that transporting of the workpiece 16 by the conveyor 14 has stopped, and the controller 74 outputs a valve shutoff signal Sa to the valve 68, whereby the valve 68 is switched from an open to a closed state based on the valve shutoff signal Sa input thereto.

The static charge eliminating system 12, to which the ionizer 10 according to the above embodiment is applied, is constructed as described above. Next, with reference to FIGS. 7 through 11B, explanations shall be made concerning a process for eliminating static charges (static charge eliminating method) with respect to a workpiece 16 in the static charge eliminating system 12, and a process for adjusting the ion balance (ion balance adjusting method) within the static charge eliminating space 42 (42*a* to 42*c*).

A case shall be described in which a single electrode needle 46 is disposed inside the electrode cartridges 36*a* to 36*c* (see FIGS. 2, 3A, 4A, and 5).

First, when the conveyor 14 is operated by the conveyor control device 80 and transporting of the workpiece 16 is initiated (see FIGS. 1, 5 and 6), the controller 74 initially stops output of the valve shutdown signal Sa with respect to the valve 68. Together therewith, the controller 74 generates the positive voltage control signal Sp and the negative voltage control signal Sm (see step S1 of FIG. 7 and FIG. 8A), so that the amplitude Vp (plus voltage absolute value) of the positive voltage becomes greater than the amplitude Vm (minus voltage absolute value) of the negative voltage (Vp>Vm), and further, so that the duty ratio (Tp/T) of the positive voltage becomes smaller than the duty ratio (Tm/T) of the negative voltage (Tp/T<Tm/T), and the positive voltage control signal Sp and the negative voltage control signal Sm are output respectively to the positive polarity high voltage generator 76 and the negative polarity high voltage generator 78.

Owing thereto, based on the positive voltage control signal Sp, the positive polarity high voltage generator 76 generates a positive voltage having an amplitude Vp in a time band Tp within the period T, and applies the same to the electrode needle 46, whereas, based on the negative voltage control signal Sm, the negative polarity high voltage generator 78 generates a negative voltage having an amplitude Vm in a time band Tm within the period T, and applies the same to the electrode needle 46 (step S2). In this case, within the period T, because negative and positive voltages are applied alternately with respect to the electrode needle 46, a corona discharge is caused at the distal end side of the electrode needle 46, and positive ions 38 and negative ions 40 are generated alternately inside the static charge eliminating space 42.

Further, as noted above, by suspending output of the valve stop signal Sa from the controller 74 with respect to the valve 68, the valve 68 is switched from a closed state into an open state, and as a result, compressed air is led out from the compressed air supply source 70 (see FIG. 5), through the flow passage 72, the valve 68, the flow passages 28, 64, and the holes 54, 56. In this case, due to movement of the compressed air, which is ejected from the hole 56 in the direction of the workpiece 16 via the cavities 44, alternately generated positive ions 38 and negative ions 40 are released toward the workpiece 16 from the electrode needle 46 within the static charge eliminating space 42 (42*a* to 42*c*). Consequently, removal of static charges with respect to the workpiece 16 (i.e., neutralizing of positive and negative charges that have charged the workpiece 16 by the positive ions 38 and the negative ions 40) is carried out within the static charge eliminating space 42.

In addition, within each predetermined time interval (within each period T), the controller 74 carries out a determination as to whether input of the conveyor control signal Sc from the conveyor control device 80 has been halted or not, that is, whether transporting of the workpiece 16 has been completed (i.e., whether the charge removal operation has been completed) or not (step S3). In the case that inputting of the conveyor control signal Sc is present (NO in step S3), next, it is determined whether or not the ion balance has become deteriorated (step S4).

In step S4, the controller 74 calculates a time average of the return current Ir and/or the potential based on the current detection signal Si from the current detector 84 and/or the potential signal Sv from the surface potential sensor 20. Next, the controller 74 determines whether or not the time average of the return current Ir and/or the potential is of a zero level. In this case, if the time average is substantially at a zero level, the controller 74 judges that the ion balance of the static charge eliminating space 42 is in equilibrium, and returns to the process of step S3. As a result thereof, in the ionizer 10, the positive voltage control signal Sp and the negative voltage control signal Sm are output repeatedly at the time interval of the period T, to the positive polarity high voltage generator 76 and to the negative polarity high voltage generator 78, whereupon the positive polarity high voltage generator 76 and the negative polarity high voltage generator 78 repeatedly apply the positive voltage and the negative voltage alternately with respect to the electrode needle 46 at the time interval of the period T.

Further, in step S3, in the event that the conveyor control signal Sc is not input from the conveyor control device 80, since transporting of the workpiece 16 has been completed, the controller 74 determines that it is necessary to terminate the static charge eliminating operation (YES in step S3). Next, the controller 74 halts output of the positive voltage control signal Sp and the negative voltage control signal Sm with respect to the positive polarity high voltage generator 76 and the negative polarity high voltage generator 78, together with outputting the valve stop signal Sa to the valve 68, whereby the valve 68 is switched from an open state into a closed state. Consequently, application of the positive voltage and the negative voltage with respect to the electrode needle 46 is halted, generation of positive ions 38 and negative ions 40 in the static charge eliminating space 42 is stopped, and ejection of compressed air with respect to the workpiece 16 from the cavities 44 is stopped by closing of the valve 68, and as a result, operations of the ionizer 10 are brought to an end (step S5).

Incidentally, in step S4, when it is determined that the ion balance in the static charge eliminating space 42 has become deteriorated, because the time average of the return current Ir and/or the potential is not at a zero level, but rather is of a level having a positive or negative polarity (YES in step S4), next, it is determined whether or not the ion balance has shifted toward the positive ion 38 side (in the plus direction) (step S6).

More specifically, in step S6, when the controller 74 determines that the time average is of a positive level (YES in step S6), for example, if it is determined that the return current Ir is a current in the positive direction (i.e., a current flowing from the conveyor 14 in the direction of the resistor 82 through ground), first, the amplitude Vm of the negative voltage is increased, and then the controller 74 judges whether the negative voltage amplitude Vm, after being increased, has exceeded a predetermined threshold Vth or not (step S7).

In step S7, if it is judged that the threshold Vth has not been exceeded (NO in step S7), the controller 74 decides to increase the negative voltage amplitude Vm, and outputs a negative voltage control signal Sm, which includes control content concerning the increased amplitude Vm', to the negative polarity high voltage generator 78. Owing thereto, based on the input negative voltage control signal Sm, the negative polarity high voltage generator 78 applies a negative voltage having an amplitude Vm' (see FIGS. 8B and 9) (step S8). Thereafter, the controller 74 returns to the process of step S3.

Next, an explanation shall be given concerning the significance of adjusting the ion balance by increasing (raising) the negative voltage.

When the ionizer 10 is used over a long period of time, dust may become adhered to the distal end side of the electrode needle 46, thus contaminating the electrode needle 46, or alternatively, there is a concern that the electrode needle 46 may become worn, such that the generated amount of positive ions 38 and negative ions 40 tends to decrease.

Figure 11A:
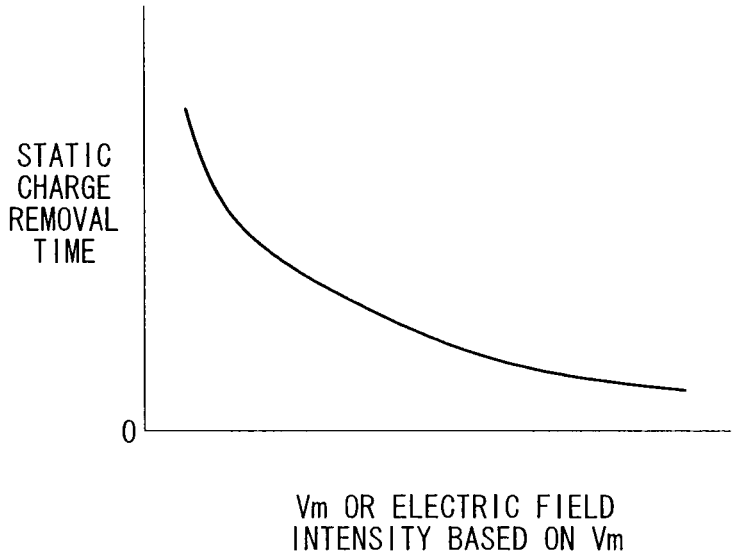
FIG. 11A is a graph showing a static charge eliminating time period of a workpiece during application of a negative voltage.
Figure 11B:
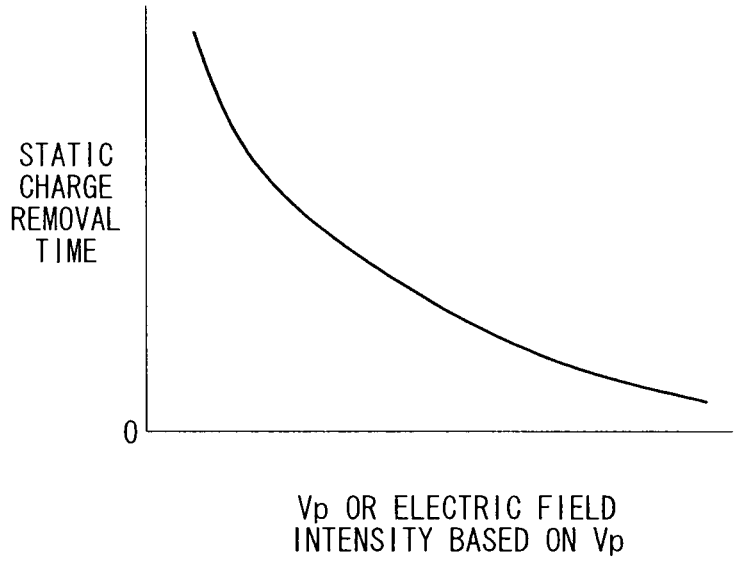
FIG. 11B is a graph showing a static charge eliminating time period of a workpiece during application of a positive voltage.

Further, in the case that a positive voltage or a negative voltage is applied to the electrode needle 46, concerning the charge removal time (time required to eliminate static charge), when the amplitude Vp, Vm of the positive voltage or the negative voltage is the same, a difference due to voltage polarity is not perceived (see FIGS. 11A and 11B). However, on the other hand, concerning the density of ozone (ozone density) generated inside the static charge eliminating space 42 (42*a* to 42*c*), when the amplitude Vp, Vm of the positive voltage or the negative voltage is the same, the ozone density is substantially greater in the case of negative voltage than in the case of positive voltage (see FIGS. 10A and 10B).

Accordingly, when the amplitude Vm of the negative voltage is large, metals (for example, the tungsten electrode needle 46) used in the ionizer 10 and the static charge eliminating system 12 become oxidized and suffer from corrosion. Alternatively, a concern exists in that the user of the ionizer may sense the ozone as an unusual odor. In this case, if the amplitude Vm of the negative voltage applied to the electrode needle 46 is kept small, it is possible to reduce the ozone density (see FIG. 10A). However, when the amplitude Vm is reduced, because the electric field intensity at the distal end side of the electrode needle 46 decreases and the generated amount of negative ions 40 is reduced, the ion balance between positive ions 38 and negative ions 40 is destroyed, and the time required to eliminate static charges from the workpiece 16 becomes rather long (see FIG. 11A).

Therefore, according to the present embodiment, by setting the amplitude Vm of the negative voltage to be comparatively small, the ozone density caused by application of the negative voltage is reduced, whereas by lengthening the time period for which the negative voltage is applied (the time Tm for which the negative voltage is applied to the electrodes 46, 58), the reduction in the amount of generated negative ions 40 due to reducing the amplitude Vm of the negative voltage is compensated for. In this case, by lengthening the time period (time Tm) for which the negative voltage is applied, it is also essential that the time period of the positive voltage (i.e., the time Tp for which the positive voltage is applied to the electrode 46) be shortened. For this reason, the amplitude Vp of the positive voltage is set larger. More specifically, by increasing the amplitude Vp of the positive voltage, the reduction in the generated amount of positive ions due to shortening the time period for which the positive voltage is applied is compensated for. Owing thereto, the ion balance between positive ions 38 and negative ions 40 can be adjusted (maintained).

In addition, according to the present embodiment, the generated amount of positive ions 38 (positive ion amplitude Vp) is standardized. In the case that the generated amount of negative ions is reduced, and the ion balance is shifted toward the positive ion 38 side due to adhering of dust on the distal end side of the electrode needle 46, or by wear on the electrode needle 46, the controller 74 carries out the process of steps S6 to S8, so that the amplitude Vm of the negative voltage is increased to Vm'. By increasing the generated amount of negative ions 40, even upon adhering of dust, or in the case of wear on the electrode needle 46, the shift in ion balance can be quickly adjusted.

In FIGS. 10A, 10B, 11A and 11B, the amplitudes Vp, Vm of the positive and negative voltages, or the electric field intensity at the distal end of the electrode needle 46 based on the amplitudes Vp and Vm, is taken along the horizontal axis.

The above signifies an adjustment of the ion balance by increasing (raising) the negative voltage.

Figure 7:
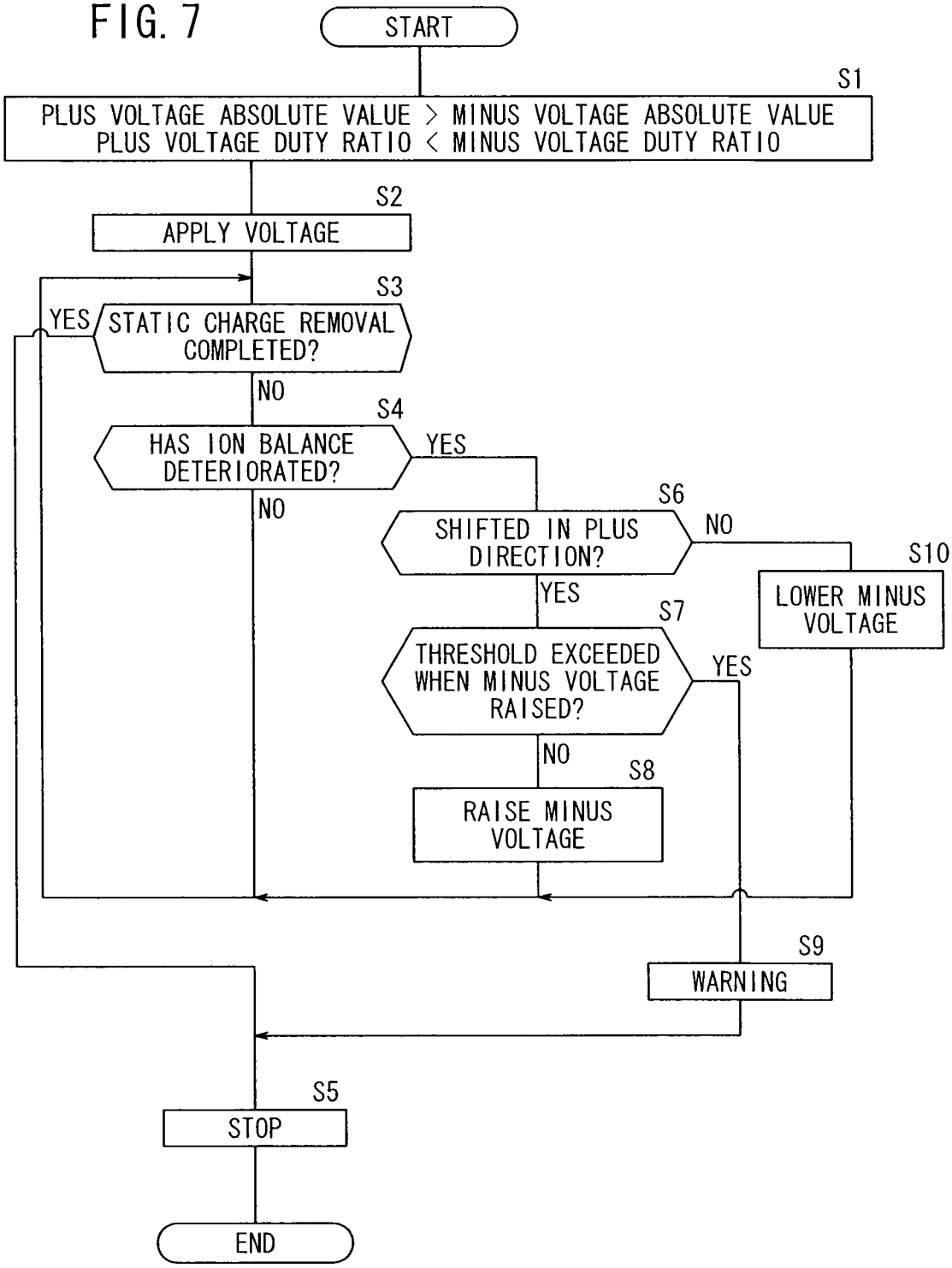
FIG. 7 is a flow chart of a static charge eliminating method for a workpiece and an ion balance adjusting method.

Returning to the flowchart of FIG. 7, in step S7, when the controller 74 increases the amplitude Vm of the negative voltage to Vm', in the event it is determined there is a concern that the amplitude Vm", after having been increased, will exceed the threshold Vth (Vm">Vth) (YES in step S7 and FIG. 9), a warning signal Se, which indicates that the threshold is exceeded, is output to the display device 32. The display device 32 warns the user based on the warning signal Se (step S9). Thereafter, even if the workpiece 16 is currently being transported by the conveyor 14, the controller 74 carries out the termination process of step S5.

More specifically, because the amplitude Vm of the negative voltage is smaller than the amplitude Vp of the positive voltage, when the electrode needle 46 becomes contaminated, the generated amount of negative ions 40 is reduced in a short time more so than the generated amount of positive ions 38. Further, because the absolute value Vp of the positive voltage is greater than the absolute value Vm of the negative voltage, even if the electrode needle 46 becomes contaminated, the generated amount of positive ions 38 is not decreased to the same degree as the generated amount of negative ions 40. Accordingly, compared to the generated amount of positive ions 38, the generated amount of negative ions 40 changes more sensitively with respect to contamination of the electrode needle 46. Consequently, as discussed above, if it is judged that the electrode needle 46 has become contaminated by determining whether or not the amplitude Vm" has exceeded the threshold Vth, contamination of the electrode needle 46 can be reliably detected.

Furthermore, in step S6, when the controller 74 determines that the time average is of a negative level (NO in step S6), for example, when it is determined that the return current Ir is a current flowing in the negative direction (a current flowing from the resistor 82 toward the conveyor 14 through ground), a negative voltage control signal Sm for reducing the amplitude Vm of the negative voltage is generated and output to the negative polarity high voltage generator 78. As a result thereof, the negative polarity high voltage generator 78 applies a negative voltage, after having reduced the amplitude Vm thereof, to the electrode needle 46 based on the input negative voltage control signal Sm (step S10). The controller 74 then returns to the process of step S3.

As described above, with the ionizer 10 and the static charge eliminating system 12 according to the present embodiment, during the time that positive and negative voltages are applied with respect to the electrode needle 46, 58, the amplitude Vm (absolute value) of the negative voltage is set to be smaller than the amplitude Vp (absolute value) of the positive voltage (Vp>Vm). Further, the application time period (time Tm) of the negative voltage is set to be longer than the application time period (time Tp) of the positive voltage (Tp<Tm). Stated otherwise, the amplitude Vp of the positive voltage is set to be greater than the amplitude Vm of the negative voltage, while the application time period of the positive voltage is set to be shorter than the application time period of the negative voltage.

That is, since the amplitude Vm of the negative voltage is set comparatively small, even when the positive voltage and the negative voltage are applied alternately and positive ions 38 and negative ions 40 are generated inside the static charge eliminating space 42 (42*a* to 42*c*), generation of ozone by application of the negative voltage can reliably be controlled. As a result, the generated amount of ozone is reduced, oxidization of metals utilized in the ionizer 10 and the static charge eliminating system 12 can be prevented reliably, together with enhancing the commercial value of the ionizer 10 and the static charge eliminating system 12.

Further, because the application time of the negative voltage is set longer corresponding to the reduction in the amplitude Vm of the negative voltage, the application time of the positive ions inevitably is set shorter. In consideration thereof, the amplitude Vp of the positive voltage is set to be large. More specifically, by lengthening the application time of the negative voltage, the reduction in the generated amount of negative ions 40 due to reducing the amplitude Vm of the negative voltage is compensated for, whereas on the other hand, by increasing the amplitude Vp of the positive voltage, the reduction in the generated amount of positive ions 38 due to shortening the application time of the positive ions is compensated for. Owing thereto, the ion balance between positive ions 38 and negative ions 40 can easily be adjusted (maintained), and positive and negative charges, which have charged the workpiece 16, can be eliminated rapidly.

Thus, according to the present embodiment, by applying positive and negative voltages alternately to the electrode needle 46, 58 with the above set conditions, and alternately generating positive ions 38 and negative ions 40, the generated amount of ozone can be reduced, ion balance can be maintained, and the time required to remove static charges from the workpiece can be shortened, in one sweep.

Further, even in the event that the generated amounts of positive ions 38 and negative ions 40 are reduced as a result of dust becoming adhered to and contaminating the electrode needle 46, 58, or by wear on the electrode needle 46, 58 due to use of the ionizer 10 over a prolonged time period, by adjusting the amplitudes Vp, Vm of the negative voltage and/or the positive voltage based on the potential signal Sv from the surface potential sensor 20, which serves as an ion balance detecting sensor, and/or based on the current detection signal Si (detection result) from the current detector 84, changes over time in ion balance or in the time required to remove static charges from the workpiece can be suppressed.

More specifically, in the case that the detection result indicates that the amount of positive ions 38 in the static charge eliminating space 42 is greater than the amount of negative ions 40, by increasing the amplitude Vm of the negative voltage corresponding to the difference between the amount of positive ions 38 and the amount of negative ions 40, even if the ion balance is shifted toward the positive ion 38 side due to lowering of the generated amount of negative ions 40, such a shift in ion balance is reliably detected and quickly can be adjusted.

Further, when it is judged that the amplitude Vm of the negative voltage after being increased (Vm") exceeds the threshold Vth, as a result of the display device 32 externally notifying such a judgment result, the user of the ionizer 10 and the static charge eliminating system 12 can determine that the electrode needle 46, 58 has become contaminated due to dust becoming adhered thereto, or that the electrode needle 46, 58 has become worn, such that even if a negative voltage of a higher voltage level is applied to the electrode needle 46, 58, an increase in the amount of generated negative ions 40 cannot be expected and the time required to eliminate static charges from the workpiece 16 will be unduly long. The user can then quickly exchange the electrode cartridges 36*a* to 36*c*. As a result, maintenance of the ionizer 10 and the static charge eliminating system 12 is facilitated.

More specifically, because the amplitude Vm of the negative voltage is smaller than the amplitude Vp of the positive voltage, when the electrode needle 46, 58 becomes contaminated, the generated amount of negative ions 40 is reduced in a short time, more so than the generated amount of positive ions 38. Further, because, the amplitude Vp of the positive voltage is greater than the amplitude Vm of the negative voltage, even if the electrode needle 46, 58 becomes contaminated, the generated amount of positive ions 38 does not decrease to the same degree as the generated amount of negative ions 40. Accordingly, compared to the generated amount of positive ions 38, the generated amount of negative ions 40 is subject to change sensitively with respect to contamination of the electrode needle 46, 58. Consequently, according to the present embodiment as described above, by determining whether or not the amplitude Vm (Vm") of the negative voltage has exceeded the threshold Vth, it can quickly be determined whether or not the electrode needle 46, 58 has become contaminated, and therefore, contamination of the electrode needle 46, 58 can be reliably detected.

Further, in the case of a detection result which indicates that the generated amount of negative ions 40 is greater than the generated amount of positive ions 38 in the static charge eliminating space 42, if the amplitude Vm of the negative voltage is reduced corresponding to the difference between the amount of positive ions 38 and the amount of negative ions 40, even if the ion balance has shifted toward the negative ion 40 side, such a shift in ion balance can be detected reliably and can quickly be adjusted. More specifically, because the generated amount of negative ions 40 is easily subject to change, the ion balance can reliably be adjusted by changing the amplitude Vm of the negative voltage.

Furthermore, as described above, the current detector 84 detects the return current Ir that flows through the resistor 82, or the surface potential sensor 20 detects the potential in the static charge eliminating space 42, whereupon the controller 74 adjusts the amplitudes Vp, Vm of the positive and/or negative voltages based on such detection results. Therefore, shifts in ion balance can easily be adjusted.

Still further, in the case that the sum of a time period (time Tp) during which the positive voltage is applied one time to the electrode needle 46 and a time period (time Tm) during which the negative voltage is applied one time to the electrode needle equals one period T, the controller 74 calculates a time average (i.e., time average of the return current Ir or time average of the potential) of the ion balance between the positive ions 38 and the negative ions 40 over at least the one period T, and adjusts the absolute value Vp, Vm of the positive voltage and/or the negative voltage based on the calculation result thereof. Therefore, ion balance can be adjusted with high precision.

Still further, since based on the aforementioned detection result, the controller 74 outputs a positive voltage control signal Sp to the positive polarity high voltage generator 76, and also outputs a negative voltage control signal Sm to the negative polarity high voltage generator 78, a feedback control for adjusting the absolute values Vp, Vm of the positive voltage and/or the negative voltage corresponding to shifts in the ion balance can be securely performed.

Still further, because electrode needles 46, 58 are used, the electric field intensity at the distal end sides of the electrode needles 46, 58 when positive or negative voltages are applied thereto is made large, and thus the generated amounts of positive ions 38 or negative ions 40 can be increased easily.

Still further, by arranging the ground electrode 66 so as to be distanced from the electrode needles 46, 58 on the side of the terminals 48, 60 of the electrode needles 46, 58, the electric field intensity at the distal ends sides of the electrode needles 46, 58 is determined by the positional relationship between the electrode needles 46, 58 and the ground electrode 66. As a result, variations in the generated amount of positive ions 38 and negative ions 40 caused by the distance between the electrode needles 46, 58 and the workpiece 16 can be reliably suppressed.

Still further, when the negative voltage or the positive voltage is applied to the electrode needle 46, 58, the compressed air supply source 70 supplies compressed air to the ionizer 10 through the flow passage 72, the valve 68 and the flow passage 28, and the ionizer 10 ejects the compressed air in a direction from the electrode needle 46, 58 toward the workpiece 16. Owing thereto, positive ions 38 and negative ions 40 are made to arrive reliably at the workpiece 16 by the ejected compressed air, and removal of static charges from the workpiece 16 can be carried out highly efficiently.

The static charge eliminating system 12 according to the present embodiment is not limited by the foregoing descriptions, and modifications to the various structures thereof are possible.

Figure 12:
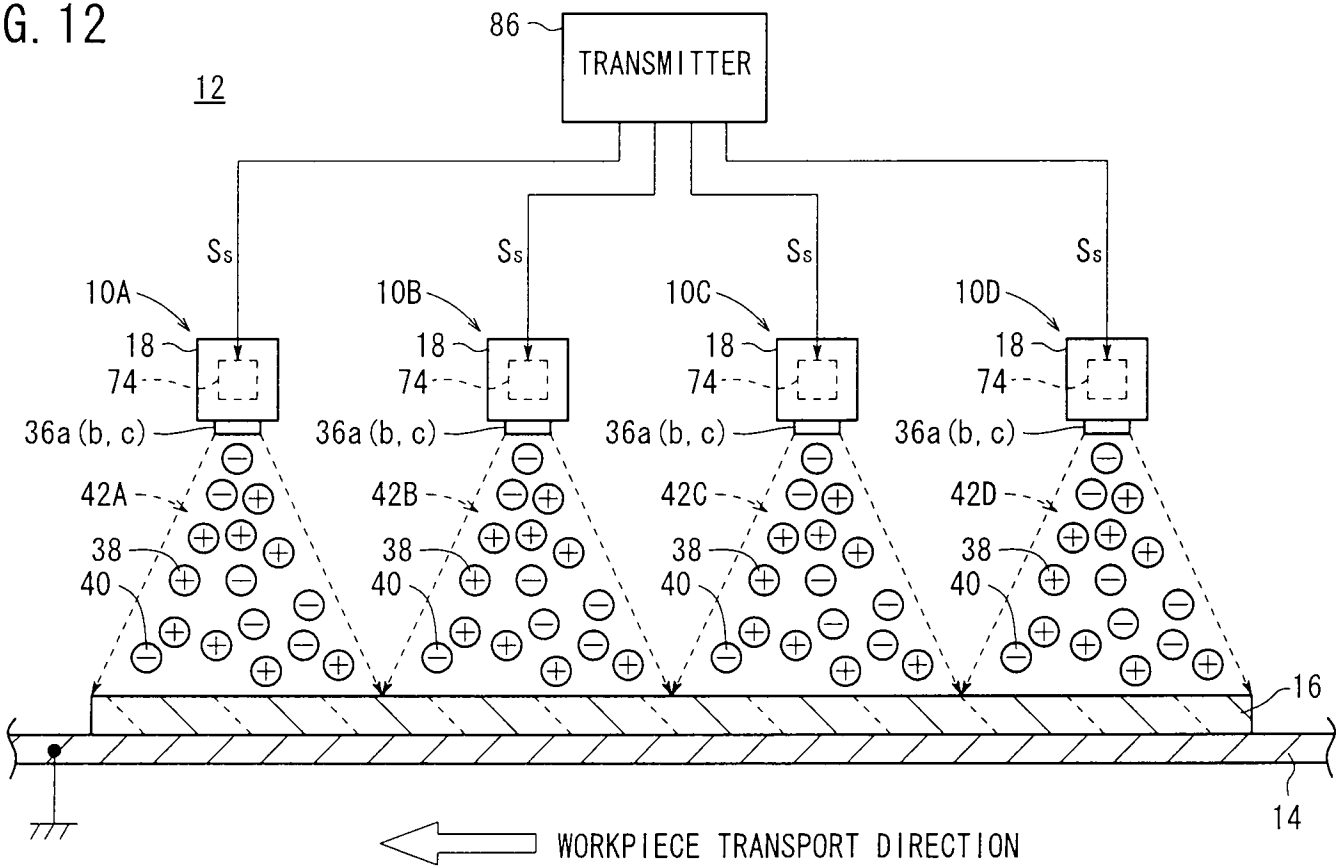
FIG. 12 is a schematic block diagram of a static charge eliminating system having a plurality of ionizers.

More specifically, as shown in FIG. 12, ionizers 10A to 10D may be disposed at predetermined intervals along the transport direction of the workpiece 16 above the conveyor 14, and when static charges are removed from the workpiece 16, a synchronizing signal Ss is output with respect to each of the ionizers 10A to 10D from a transmitter (synchronizing control means) 86.

Figure 13A:
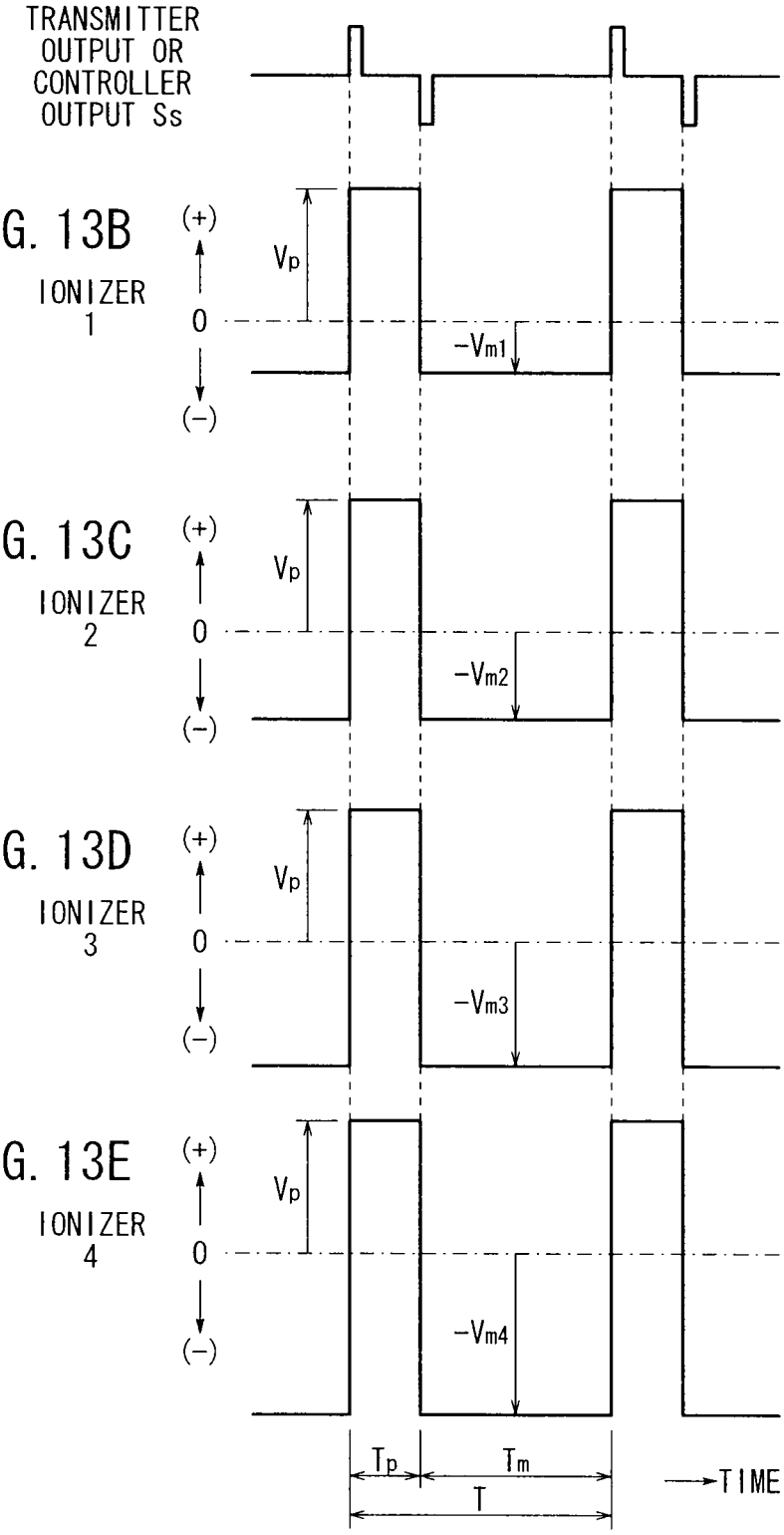

In this case, the ionizers 10A to 10D have structures similar to the aforementioned ionizer 10, and further, the polarities of the voltages applied to the electrode needles 46 are all switched together, at a given timing determined by the synchronizing signal Ss (see FIG. 13).

Consequently, as shown in FIGS. 13A to 13E, in each of the ionizers 10A to 10D (first through fourth ionizers), based on input of the synchronizing signal Ss thereto which is made up from negative and positive pulses, polarities of voltages that are synchronized with positive pulses and applied to the electrode needles 46 can all be switched together from a negative voltage to a positive voltage, whereas polarities of voltages that are synchronized with negative pulses and applied to the electrode needles 46 can all be switched together from a positive voltage to a negative voltage.

Moreover, in FIG. 12, reference numerals 42A to 42D indicate static charge eliminating spaces made up of positive ions 38 and negative ions 40, which are released from each of the ionizers 10A to 10D, wherein the aforementioned static charge eliminating spaces 42*a* to 42*c* are viewed from sides of the ionizers 10A to 10D. Further, so that an upper surface along the transport direction of the workpiece 16 is covered by the static charge eliminating spaces 42A to 42D, the static charge eliminating spaces 42A to 42D have shapes that are enlarged toward the workpiece 16 from the ionizers 10A to 10D. Further, as shown in FIGS. 13A to 13E, when negative voltages are applied, negative voltages having mutually different amplitudes (negative voltages of amplitudes Vm1 to Vm4) are applied respectively to the electrode needles 46 of each of the ionizers 10A to 10D.

Figure 14:
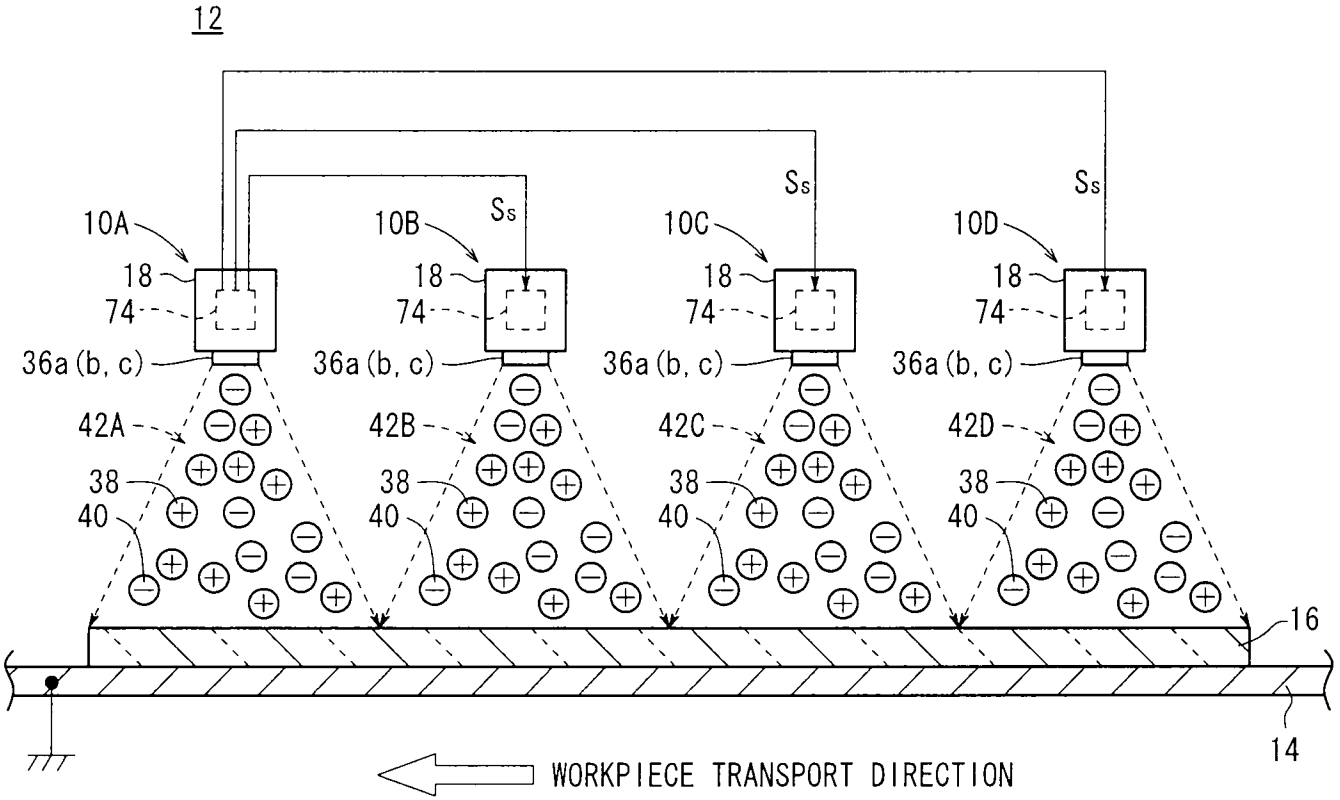
FIG. 14 is a schematic block diagram of a static charge eliminating system having a plurality of ionizers.

Further, as shown in FIG. 14, among the ionizers 10A to 10D, the controller 74 of the ionizer 10A may have a function similar to the aforementioned transmitter 86 (see FIG. 12), such that a synchronizing signal Ss may be output from the ionizer 10A to the other ionizers 10B to 10D. In this case as well, each of the ionizers 10A to 10D can carry out synchronized switching of voltage polarity, as indicated by the time charts of FIGS. 13A to 13E.

In this manner, with the static charge eliminating system 12 shown in FIGS. 12 and 14, in the event that the plural ionizers 10A to 10D are operated simultaneously to eliminate static charges from the workpiece 16, since switching of the voltage polarities of each of the ionizers 10A to 10D is synchronized, removal of static charges from the workpiece 16 can be performed efficiently. Further, with the structure of FIGS. 12 and 14, since switching of the voltage polarities is performed based on input of an external synchronizing signal Ss, assuming that at least one of the ionizers is driven and operated, removal of static charges from the workpiece 16 can be carried out. More specifically, even in the case that only one of the ionizers among the ionizers 10A to 10D shown in FIG. 12 is driven, or in the event that the ionizer 10A in FIG. 14 is made to function as a transmitter and only one of the ionizers among the ionizers 10B to 10D is driven, elimination of static charges with respect to the workpiece 16 can be carried out.

The present invention is not limited to the aforementioned embodiments, and it is a matter of course that various alternative or additional structures may be adopted therein, without deviating from the essence and gist of the present invention.

What is claimed is:

1. An ionizer comprising:

at least one needle-shaped electrode arranged such that a distal end side thereof projects from within an ionizer main body; and a plate-shaped ground electrode arranged at a base end side of the needle-shaped electrode within the ionizer main body and distanced from a static charge eliminating space and the needle-shaped electrode, such that the ground electrode lies substantially perpendicular to the needle-shaped electrode, wherein an absolute value of a negative voltage applied to the needle-shaped electrode is set to be smaller than an absolute value of a positive voltage applied to the needle-shaped electrode, and a time period for which the negative voltage is applied to the needle-shaped electrode is set to be longer than a time period for which the positive voltage is applied to the needle-shaped electrode, wherein generation of positive ions at the distal end side of the needle-shaped electrode within the static charge eliminating space by application of the positive voltage to the needle-shaped electrode is carried out alternately with generation of negative ions at the distal end side of the needle-shaped electrode within the static charge eliminating space by application of the negative voltage to the needle-shaped electrode, wherein the ionizer further comprises:

ion balance detecting means for detecting an ion balance of the positive ions and the negative ions in the static charge eliminating space, control means for controlling at least one of the positive voltage and the negative voltage; and warning means, wherein the ion balance detecting means includes a potential detecting means arranged inside the static charge eliminating space, for detecting a potential corresponding to an amount of the positive ions and an amount of the negative ions in the static charge eliminating space, wherein assuming that a sum of a time period during which the positive voltage is applied one time to the needle-shaped electrode and a time period during which the negative voltage is applied one time to the needle-shaped electrode equals one period, the control means calculates a time average of the potential corresponding to the ion balance of the positive ions and the negative ions over at least the one period, and increases only the absolute value of the negative voltage in a state in which the absolute value of the positive voltage is maintained constant corresponding to a difference between the amount of the positive ions and the amount of the negative ions in the case that the calculation result indicates that the amount of the positive ions is greater than the amount of the negative ions in the static charge eliminating space, and wherein, when the absolute value of the negative voltage is increased, the control means outputs a determination result to the warning means if it is determined that the absolute value of the negative voltage after being increased exceeds a predetermined threshold, and wherein the warning means provides a visual indication of the determination result, to an outside of the ionizer.

2. An ionizer according to claim 1, wherein, in the case that the calculation result indicates that the potential corresponding to an amount of the negative ions is greater than the potential corresponding to an amount of the positive ions in the static charge eliminating space, the control means decreases the absolute value of the negative voltage corresponding to a difference between the potential corresponding to the amount of the negative ions and the potential corresponding to the amount of the positive ions.

3. An ionizer according to claim 1, the control means comprising a controller that generates a control signal, and a voltage generator connected to the needle-shaped electrode, which generates the positive voltage and the negative voltage based on the control signal and applies the positive voltage and the negative voltage to the needle-shaped electrode, wherein, when the potential detecting means detects the potential corresponding to the ion balance, the controller generates the control signal corresponding to the calculation result, and the voltage generator adjusts only the absolute value of the negative voltage based on the control signal.

4. An ionizer according to claim 1, wherein the ionizer switches a polarity of the voltage applied to the needle-shaped electrode at a timing determined by an external signal.

5. An ionizer according to claim 4, wherein, in the case that a plurality of the ionizers are provided, the polarities of voltages applied to the needle-shaped electrodes of each of the ionizers all are changed simultaneously, at a timing determined by the signal.

6. An ionizer according to claim 1, wherein:

in the case that a plurality of the ionizers are provided, among such ionizers, one of the ionizers outputs a synchronizing signal to the other ionizer; and the polarities of voltages applied to the needle-shaped electrodes of each of the ionizers all are changed simultaneously, at a timing determined by the synchronizing signal.

7. A static charge eliminating system comprising the ionizer according to claim 1, and a workpiece transporting means for transporting a workpiece, wherein, when the workpiece is transported into the static charge eliminating space by the workpiece transporting means, electric charges that have charged the workpiece are neutralized by the positive ions and the negative ions, thereby eliminating the static charges from the workpiece.

8. The static charge eliminating system according to claim 7, further comprising:

an air supply source connected to the ionizer through a flow passage, wherein, when the positive voltage or the negative voltage is applied to the needle-shaped electrode, the air supply source supplies air to the ionizer through the flow passage and wherein the ionizer ejects the air in a direction from the needle-shaped electrode toward the workpiece.

9. An ionizer comprising:

at least two needle-shaped electrodes arranged such that a distal end side of each of the needle-shaped electrodes projects from within an ionizer main body; and a plate-shaped ground electrode arranged at a base end side of each of the needle-shaped electrodes within the ionizer main body and distanced from a static charge eliminating space and each of the needle-shaped electrodes, such that the ground electrode lies substantially perpendicular to each of the needle-shaped electrodes, wherein an absolute value of a negative voltage applied to one of the needle-shaped electrodes is set to be smaller than an absolute value of a positive voltage applied to another of the needle-shaped electrodes, and a time period for which the negative voltage is applied to the one needle-shaped electrode is set to be longer than a time period for which the positive voltage is applied to the other needle-shaped electrode, wherein generation of positive ions at the distal end side of the other needle-shaped electrode within the static charge eliminating space by application of the positive voltage to the other needle-shaped electrode is carried out alternately with generation of negative ions at the distal end side of the needle-shaped electrode within the static charge eliminating space by application of the negative voltage to the one needle-shaped electrode, wherein the ionizer further comprises:

ion balance detecting means for detecting an ion balance of the positive ions and the negative ions in the static charge eliminating space, control means for controlling at least one of the positive voltage and the negative voltage; and warning means, wherein the ion balance detecting means includes a potential detecting means arranged inside the static charge eliminating space, for detecting a potential corresponding to an amount of the positive ions and an amount of the negative ions in the static charge eliminating space, wherein assuming that a sum of a time period during which the positive voltage is applied one time to the other needle-shaped electrode and a time period during which the negative voltage is applied one time to the one needle-shaped electrode equals one period, the control means calculates a time average of the potential corresponding to the ion balance of the positive ions and the negative ions over at least the one period, and increases only the absolute value of the negative voltage in a state in which the absolute value of the positive voltage is maintained constant corresponding to a difference between the amount of the positive ions and the amount of the negative ions in the case that the calculation result indicates that the amount of the positive ions is greater than the amount of the negative ions in the static charge eliminating space, and wherein, when the absolute value of the negative voltage is increased, the control means outputs a determination result to the warning means if it is determined that the absolute value of the negative voltage after being increased exceeds a predetermined threshold, and wherein the warning means provides a visual indication of the determination result, to an outside of the ionizer.

10. An ion balance adjusting method, comprising the steps of:

in the case that at least one needle-shaped electrode is arranged such that a distal end side thereof projects from within an ionizer main body, and a plate-shaped ground electrode is arranged at a base end side of the at least one needle-shaped electrode within the ionizer main body and is distanced from a static charge eliminating space and the needle-shaped electrode such that the ground electrode lies substantially perpendicular to the needle-shaped electrode, setting an absolute value of a negative voltage applied to the at least one needle-shaped electrode to be smaller than an absolute value of a positive voltage applied to the needle-shaped electrode, and setting a time for which the negative voltage is applied to the needle-shaped electrode to be longer than a time for which the positive voltage is applied to the needle shaped electrode; and alternately performing generation of positive ions at the distal end side of the needle-shaped electrode within the static charge eliminating space by application of the positive voltage to the needle-shaped electrode and generation of negative ions at the distal end side of the needle-shaped electrode within the static charge eliminating space by application of the negative voltage to the needle-shaped electrode, detecting a potential corresponding to an ion balance of the positive ions and the negative ions in the static charge eliminating space by potential detecting means, assuming that a sum of a time period during which the positive voltage is applied one time to the needle-shaped electrode and a time period during which the negative voltage is applied one time to the needle-shaped electrode equals one period, calculating a time average of the potential corresponding to the ion balance of the positive ions and the negative ions over at least the one period by control means; and increasing only the absolute value of the negative voltage in a state in which the absolute value of the positive voltage is maintained constant corresponding to a difference between an amount of the positive ions and an amount of the negative ions in the case that the calculation result indicates that the amount of the positive ions is greater than the amount of the negative ions in the static charge eliminating space; and providing a visual indication of the determination result by warning means to an outside of the ionizer, if it is determined that the absolute value of the negative voltage after being increased, exceeds a predetermined threshold when the absolute value of the negative voltage has been increased.

11. A workpiece static charge eliminating method, when the generation of the positive ions and the generation of the negative ions are alternately performed in the static charge eliminating space according to the method of claim 10, comprising the steps of:

transporting a workpiece into the static charge eliminating space by workpiece transporting means; and neutralizing electric charges that have charged the workpiece by the positive ions and the negative ions, thereby eliminating static charges from the workpiece.

12. An ion balance adjusting method, comprising the steps of:

in the case that each of at least two needle-shaped electrodes is arranged such that a distal end side of each of the needle-shaped electrodes projects from within an ionizer main body, and a plate-shaped ground electrode is arranged at a base end side of each of the at least two needle-shaped electrodes in the ionizer main body and is distanced from a static charge eliminating space and each of the needle-shaped electrodes, such that the ground electrodes lies substantially perpendicular to each of the needle-shaped electrodes, setting an absolute value of a negative voltage applied to one needle-shaped electrode to be smaller than an absolute value of a positive voltage applied to another needle-shaped electrode, and setting a time for which the negative voltage is applied to the one needle-shaped electrode to be longer than a time for which the positive voltage is applied to the other needle shaped electrode;

alternately performing generation of positive ions at the distal end side of the other needle-shaped electrode within the static charge eliminating space by application of the positive voltage to the other needle-shaped electrode and generation of negative ions at the distal end side of the one needle-shaped electrode within the static charge eliminating space by application of the negative voltage to the one needle-shaped electrode, detecting a potential corresponding to an ion balance of the positive ions and the negative ions in the static charge eliminating space by potential detecting means, assuming that a sum of a time period during which the positive voltage is applied one time to the other needle-shaped electrode and a time period during which the negative voltage is applied one time to the one needle-shaped electrode equals one period, calculating a time average of the potential corresponding to the ion balance of the positive ions and the negative ions over at least the one period by control means; and increasing only the absolute value of the negative voltage in a state in which the absolute value of the positive voltage is maintained constant corresponding to a difference between an amount of the positive ions and an amount of the negative ions in the case that the calculation result indicates that the amount of the positive ions is greater than the amount of the negative ions in the static charge eliminating space; and providing a visual indication of the determination result by warning means to an outside of the ionizer, if it is determined that the absolute value of the negative voltage after being increased, exceeds a predetermined threshold when the absolute value of the negative voltage has been increased.

* * * * *